US011879224B2

(12) United States Patent
Hampton

(10) Patent No.: US 11,879,224 B2
(45) Date of Patent: Jan. 23, 2024

(54) DEVICES, ASSEMBLIES, AND METHODS FOR SHORING TEMPORARY SURFACE EXCAVATIONS

(71) Applicant: Round Shield LLC, Spicewood, TX (US)

(72) Inventor: Gary W. Hampton, Spicewood, TX (US)

(73) Assignee: Round Shield LLC, Spicewood, TX (US)

( * ) Notice: Subject to any disclaimer, the term of this patent is extended or adjusted under 35 U.S.C. 154(b) by 77 days.

(21) Appl. No.: 17/565,226

(22) Filed: Dec. 29, 2021

(65) Prior Publication Data

US 2022/0251795 A1 Aug. 11, 2022

Related U.S. Application Data

(60) Provisional application No. 63/147,216, filed on Feb. 8, 2021.

(51) Int. Cl.
*E02D 7/04* (2006.01)
*E02D 17/04* (2006.01)

(52) U.S. Cl.
CPC ..... *E02D 17/04* (2013.01)

(58) Field of Classification Search
CPC . E02D 17/04; E02D 17/08; E02D 2200/1685; E02D 2220/00; E02D 17/086; E21D 13/00
See application file for complete search history.

(56) References Cited

U.S. PATENT DOCUMENTS 2,908,140 A * 10/1959 Everson, Jr. ..... E02D 17/086 405/283
3,473,336 A * 10/1969 Emanuel ..... E02D 17/086 405/283
3,668,874 A * 6/1972 Krings ..... E02D 17/08 405/282
3,729,938 A * 5/1973 Morrice ..... E02D 17/08 405/282
3,916,629 A * 11/1975 Thompson ..... E02D 17/086 405/283
3,967,454 A * 7/1976 Barnes ..... E02D 17/086 405/282
4,193,717 A * 3/1980 Treacy ..... E02D 17/08 405/283
4,279,548 A * 7/1981 Ramey ..... E02D 17/086 37/189
4,487,530 A * 12/1984 Morrice ..... E02D 17/08 405/282
6,224,296 B1 * 5/2001 Fukumori ..... E02D 17/08 405/282

(Continued)

FOREIGN PATENT DOCUMENTS

JP 2004052398 A 2/2004
JP 2009024368 A 2/2009

*Primary Examiner* — Carib A Oquendo
(74) *Attorney, Agent, or Firm* — The Culbertson Group, P.C.; Russell D. Culbertson

(57) ABSTRACT

An assembly for shoring temporary surface excavations includes a base unit and a first extension unit. The base unit includes features for allowing the assembly to be jacked out of the excavation when hoisting becomes impossible of impractical. The shoring structure may also be jacked into an unstable excavation from above.

22 Claims, 25 Drawing Sheets

(56) References Cited

U.S. PATENT DOCUMENTS

| | | | | |
|---|---|---|---|---|
| 6,986,227 | B1 | 1/2006 | Gavin | |
| 7,025,537 | B2 | 4/2006 | Russell | |
| 10,597,842 | B1 | 3/2020 | Beller | |
| 10,858,798 | B2 | 12/2020 | Lee | |
| 2011/0318116 | A1* | 12/2011 | Cosentino | E02D 17/04 405/272 |
| 2020/0308797 | A1* | 10/2020 | Isaac | E02D 17/08 |

* cited by examiner

DEVICES, ASSEMBLIES, AND METHODS FOR SHORING TEMPORARY SURFACE EXCAVATIONS

CROSS-REFERENCE TO RELATED APPLICATION

Applicant claims the benefit, under 35 U.S.C. § 119(e), of U.S. Provisional Patent Application No. 63/147,216 filed Feb. 8, 2021, and entitled "Devices, Assemblies, and Methods for Shoring Temporary Surface Excavations." The entire content of this provisional application is incorporated herein by this reference.

TECHNICAL FIELD OF THE INVENTION

The invention relates to safety devices and systems used in connection with temporary excavations to prevent the collapse of the excavation while work within is ongoing. Aspects of the invention include temporary surface excavation shoring devices and systems of devices that may be readily removed from an excavation for reuse. Aspects of the invention also include methods of installing shoring for temporary surface excavations.

BACKGROUND OF THE INVENTION

Many types of infrastructure installations and other installations include structures that extend well below ground surface level (hereinafter "surface level") at the given location. For example, sewage lift stations and sewage junction structures may include chambers formed from concrete or other materials that extend fifty feet or more below surface level. The installation, maintenance, modification, or removal of such subsurface structures may require an excavation having an area larger than the area of the subsurface structure and at least as deep as the subsurface structure. As a matter of both safety for workers operating in an excavation and expediency in performing work within an excavation, any such excavation more than approximately four feet below surface level should be, or must by regulation be, shored to prevent a collapse of the excavation wall into the area of the excavation. For example, trench walls may be shored on each side by large metal plates extending from the bottom to the top of the trench adjacent to and roughly parallel to the trench excavation wall and supported by cross members. A trench or other excavation may also be shored using elongated boards or similar elements placed vertically adjacent and roughly parallel to the excavation wall and supported by some manner of cross-bracing frame constructed within the volume of the excavation.

While metal plate and cross member shoring structures may be easily placed in and removed in one piece from a relatively shallow excavation in some geologic conditions, eight feet or less below surface level for example, both placement and removal may be more difficult for deeper excavations and/or excavations in some geologic conditions. In relatively deep excavations and excavations in relatively unstable soil and subsoil layers, shoring may require permanent structures that are intended to remain in place and never removed. Such permanent shoring structures may be expensive and may themselves deteriorate over time. There remains a need in the field for cost-effective and functional shoring for surface excavations.

SUMMARY OF THE INVENTION

It is an object of the invention to provide a shoring assembly that may be installed even in relatively deep surface excavations and then safely removed from the excavation when the excavation is no longer needed. Other objects of the invention are to provide components for producing such a shoring assembly and extension units of a shoring assembly and methods for both installing and removing a shoring structure in a surface excavation.

An assembly for shoring temporary surface excavations according to one aspect of the present invention includes a base unit and a first extension unit. The base unit includes a base unit wall extending in a height direction from a base unit lower edge to a base unit upper edge and defines a base unit central axis extending in the height direction. The base unit wall has a base unit wall inner surface defining a volume of the base unit and a base unit wall outer surface facing way from the volume of the base unit. At least two jacking lugs and preferably more are mounted on the base unit and spaced apart about the base unit central axis. Each jacking lug extends from the base unit wall inner surface in the volume of the base unit and includes a jack receiver. Each jack receiver comprises a structure on the respective jacking lug that is positioned to receive an upper jacking force application element of a respective jacking device aligned to apply a jacking force in a direction from the base unit lower edge to the base unit upper edge. At least two and preferably more lifting features are also included on the base unit. Each lifting feature is spaced apart about the base unit central axis and resides within the volume of the base unit to providing a lifting point adapted to accept a lifting force applied from above the base unit upper edge in the height direction. The base unit further includes a number of base unit upper connecting elements spaced apart about the base unit central axis.

The first extension unit in an assembly according to this first aspect of the invention includes a first extension unit wall extending in the height direction from a first extension unit lower edge to a first extension unit upper edge. The first extension unit wall defines a first extension unit central axis extending in the height direction and also has a first extension unit wall inner surface defining a volume of the first extension unit and a first extension unit wall outer surface facing way from the volume of the first unit. A number of first extension unit lower connecting elements are included on the first extension unit spaced apart at about the extension unit central axis. Each extension unit lower connecting element is aligned with and connected to a respective base unit upper connecting element of the base unit so that the base unit central axis approximately aligns with the first extension unit central axis, to form an assembly or shoring structure central axis.

In accordance with this first aspect of the invention, the base unit wall outer surface at each point along its length extends along the distance from the base unit lower edge to the base unit upper edge approximately parallel to the base unit central axis. Additionally, the base unit wall outer surface defines the maximum dimension of the base unit along any line that intersects the base unit central axis perpendicular to the base unit central axis. Similarly, the first extension unit wall outer surface at each point along its length extends along the distance from the first extension unit lower edge to the first extension unit upper edge approximately parallel to the first extension unit central axis. Also, the first extension unit wall outer surface defines the maximum dimension of the first extension unit along any line that intersects the first extension unit central axis perpendicular to the first extension unit central axis. Both the base unit wall and the first extension unit wall defines a barrier to the volume of the respective unit so that together the base unit wall and first extension unit wall define a barrier extending from the first extension unit upper edge down to the base unit lower edge.

By including the jacking lugs on the base unit and within the volume of the base unit, an assembly according to this first aspect of the invention may be jacked out of an excavation even where portions of the excavation have caved in against the base unit wall outer surface and first extension unit wall outer surface. Ensuring that both the base unit wall outer surface and first extension unit wall outer surface extend parallel to the respective unit axis and assembly axis and represents the maximum dimension of the respective unit perpendicular to the assembly axis ensures there are no transverse edges on the outer surface of either unit that could increase the force needed to lift the assembly from an excavation. Further, in implementations of the assembly in which the base unit wall outer surface aligns with the first extension unit wall outer surface or where the first extension unit wall outer surface has a larger transverse dimension than the base unit wall outer surface, the assembly is assured of having no transverse edge along its entire height dimension that could increase the force needed to lift the assembly from an excavation. Yet the combined base unit wall and first extension unit wall provide a shoring structure volume that is protected from collapse of the excavation wall providing a safe volume for workers installing, modifying, or removing subsurface structures within the volume of the assembly. Both the base unit wall and the first extension unit wall may be approximately cylindrical in shape to help provide the desired resistance to forces transverse to the assembly axis, namely forces applied by a collapse or partial collapse of the excavation.

An assembly according to this first aspect of the present invention may include at least one additional extension unit to form a shoring assembly long enough to shore a given excavation down to a desired depth below the surface level. In such an assembly each additional extension unit includes a respective additional extension unit wall extending in the height direction from a respective additional extension unit lower edge to a respective additional extension unit upper edge. Each additional extension unit wall also defines a respective additional extension unit central axis extending in the height direction, and has a respective additional extension unit wall inner surface defining a volume of the respective additional extension unit and a respective additional extension unit wall outer surface facing way from the volume of the respective additional unit. At least a lowermost one of the at least one additional extension units includes number of additional extension unit lower connecting elements spaced apart at about the respective additional extension unit central axis. Each of these additional extension unit lower connecting elements is aligned with and connected to a respective first extension unit upper connecting element of the first extension unit so that the additional extension unit central axis approximately aligns with both the base unit central axis and the first extension unit central axis. For each respective additional extension unit the respective additional extension unit wall outer surface at each point along its length extends along the distance from the respective additional extension unit lower edge to the respective additional extension unit upper edge approximately parallel to the respective additional extension unit central axis. Additionally, the respective additional extension unit wall outer surface defines the maximum dimension of the respective additional extension unit along any line that intersects the respective additional extension unit central axis perpendicular to the respective additional extension unit central axis. Also, similarly to the base unit wall and first extension unit wall, the respective additional extension unit wall defines a barrier to the volume of the respective additional extension unit in directions transverse to the respective additional extension unit central axis. Thus the entire shoring structure made up of the base unit, first extension unit, and one or more additional extension units provides a shoring wall that protects the volume of the shoring structure from a collapse or partial collapse of the excavation wall.

In an assembly according to this first aspect of the invention made up of a base unit, a first extension unit, and at least one additional extension unit, each of the unit walls may align so that the outer wall surface of the combined structure forms approximately a straight line from the upper edge of the uppermost additional extension unit wall to the base unit wall lower edge. This arrangement provides an assembly with the desirable relatively low resistance to lifting from the excavation where there has been a collapse or partial collapse of the excavation wall.

Another aspect of the invention includes base units for use as the base unit in the above-described assembly. As described above in connection with assemblies according to the invention, a base unit includes a base unit wall, at least two and preferably more jacking lugs, at least two and preferably more lifting features, and a number of upper connecting elements, each as described above in connection with the assembly.

A base unit in accordance with either of the above-noted aspects of the invention may include three or more jacking lugs spaced apart equally about the base unit central axis. Implementations of a base unit may also include three or more lifting features spaced apart equally about the base unit central axis. Regardless of the number of lifting features included in a given implementation, at least one and as many as all of the lifting features may each be mounted on a respective lifting lug. Such a lifting lug may comprise a structure separate from any of the jacking lugs and extending from the base unit wall inner surface in the volume of the base unit. One of more or the lifting features may be included on a respective jacking lug in some implementations so that the respective jacking lug structure provides both a location for the respective lifting feature and a respective jack receiver.

In accordance with either of the above-described aspects of the invention, a base unit may include various stiffening or reinforcing features mounted on the base unit inner wall and extending into the base unit volume. Some embodiments include one or more stiffening horizontal rings aligned perpendicularly to the base unit central axis and having an outer edge connected to the base unit inner wall and an inner edge extending a short distance, on the order of inches typically, in the volume of the base unit. Such stiffening rings may be employed at the top of the base unit aligned with the base unit upper edge, at the bottom of the base unit align with the base unit lower edge, and at one or more intermediate locations between the base unit upper and lower edge. The upper stiffening ring may conveniently provide locations for the upper connecting elements of the base unit, such as bolt holes for providing a connection to an extension unit, while the lower stiffening ring may similarly provide a location for lower connecting elements of the base unit for facilitating the connection of an extraction shield device below the base unit in a shoring assembly according to the present invention. Such an extraction shield and its use will be described below in connection with the drawings.

Additional aspects of the invention include methods for both installing shoring assemblies such as those described above and extracting such assemblies from an excavation. Methods of installing a shoring structure in an excavation include excavating an area within a first excavation perimeter to produce a first excavation volume having a first excavation depth from a surface level. A base unit such as that described above is then lowered into the first excavation volume to place the base unit lower edge facing a bottom surface of the first excavation volume. With the base unit remaining in the first excavation volume, methods according to this aspect of the invention further include excavating within the first excavation perimeter further to produce a second excavation volume having a second excavation depth from the surface level greater than the first excavation depth and then connecting at least one extension unit to the base unit while at least a portion of the base unit remains in the first excavation volume. Further excavation is then conducted from within the base unit while in the second excavation volume to produce a third excavation volume having a third excavation depth that is deeper the second excavation depth. Methods according to this aspect of the invention further include applying an installation jacking force to the shoring structure to force the shoring structure further into the third excavation.

The installation jacking force applied in accordance with this aspect of the invention may be used one or multiple times over the course of the excavation to drive the shoring structure into the excavation even when portions of the excavation wall have collapsed against the base unit wall outer surface and extension unit wall outer surface. This force may be applied to the shoring structure from a support structure located above the shoring structure. Depending upon the nature of the support structure the method may include connecting the support structure via a force resistance arrangement such as suitable chains or cables to at least one anchoring device such as a soil bolt fixed at a bottom surface of the third excavation volume. Regardless of whether the support structure is connected to an anchoring device within the excavation, the installation jacking force may be applied to the shoring structure through at least two spaced apart locations of an uppermost extension unit in the shoring structure at the respective extension unit wall along an axis defined by that wall parallel to the respective extension unit central axis.

Methods of extracting a shoring structure made up of a base unit and one or more extension units include placing at least two and preferably more jacking devices within the volume of the shoring structure residing within an excavation with a lower edge of the shoring structure below a surface level. The jacking devices are then operated to apply an extraction jacking force to a respective jack receiver of the base unit to lift the shoring structure upwardly toward surface level. After the shoring structure is lifted in this fashion by applying the extraction jacking forces, methods according to this aspect of the invention include filling in the excavation with fill material at least in an area below a lower edge of the shoring structure while the shoring structure remains supported against substantial downward movement. The placement of the jacking devices, application of the jacking forces, and then infilling may be performed multiple times until the entire shoring structure has been removed from the excavation. Where the shoring structure is made up of a base unit and one or more extension units as described above, the extension unit or units may be removed from the structure as they are exposed above surface level. Ultimately, the portion of the shoring structure remaining in the excavation in the course of the extraction process may reside above a level where an excavation wall collapse has occurred. At this point a hoisting system may be used to raise the structure further until the entire structure is removed from the excavation.

These and other advantages and features of the invention will be apparent from the following description of representative embodiments, considered along with the accompanying drawings.

DESCRIPTION OF REPRESENTATIVE EMBODIMENTS

In the following description FIGS. 1 and 2 will be used to describe an overall shoring structure in accordance with aspects of the invention as installed in an excavation. FIGS. 3 through 17 will be used to describe individual components that may be included in a shoring structure such as that shown in FIGS. 1 and 2. FIGS. 18 through 21 will be used to describe methods according to the invention for installing a shoring structure such as that shown in FIGS. 1 and 2, while FIGS. 22 through 24 will be used to describe processes by which such a shoring structure may be extracted from an excavation in accordance with the present invention. FIG. 25 will be used to describe a configuration of a shoring structure in accordance with the invention employing and additional shoring device for strata near the surface level.

Figure 1:
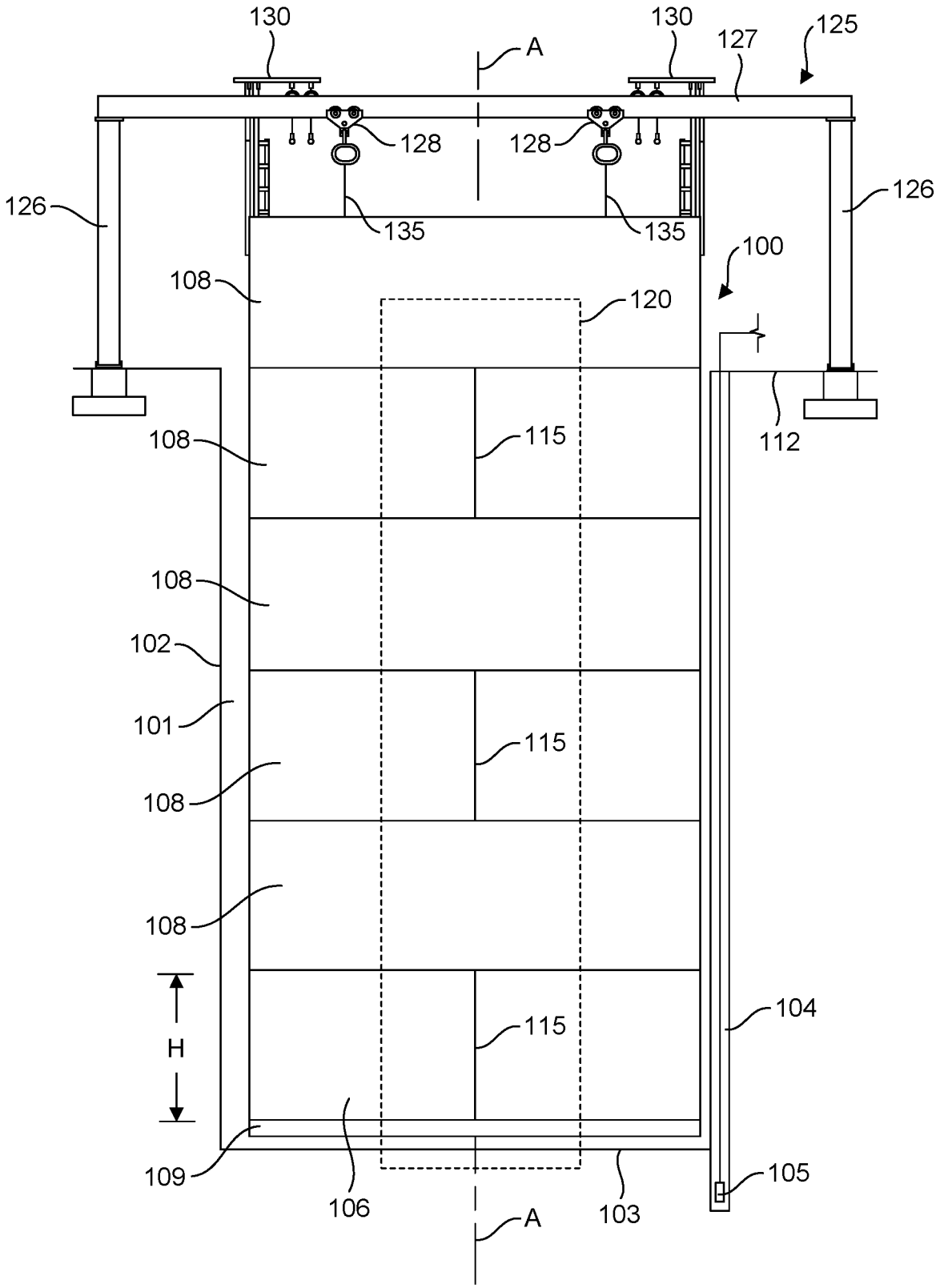
FIG. 1 is a somewhat schematic side view of a shoring structure assembly in accordance with one aspect of the present invention in an installed position within a surface excavation.

Referring to FIG. 1, a shoring structure 100 is shown in and installed position within an excavation 101 defined by an excavation side wall 102 and bottom 103. In this particular example, a dewatering shaft 104 is installed adjacent to the excavation 101 with a dewatering pump 105 shown within the dewatering shaft. Shoring structure 100 includes a base unit 106 connected together with five connected extension units 108. An extraction shield 109 is connected below base unit 106. Base unit 106 and each of the extension units 108 may for example have a height dimension H of approximately eight feet. Thus in this particular example shown in FIG. 1, the shoring structure is installed in an excavation somewhat over 40 feet deep from surface level 112. The example height dimension of eight feet is provided here solely for assistance in understanding the nature of the invention and is not intended to be limiting. The base unit 106 and extension units 108 may have any suitable height dimension H. Also although the height dimension for the base unit 106 and each extension unit 108 is shown as being the same in this example, the height dimension may vary between the base unit 106 and extension units 108 and between the extension units 108.

Figure 2:
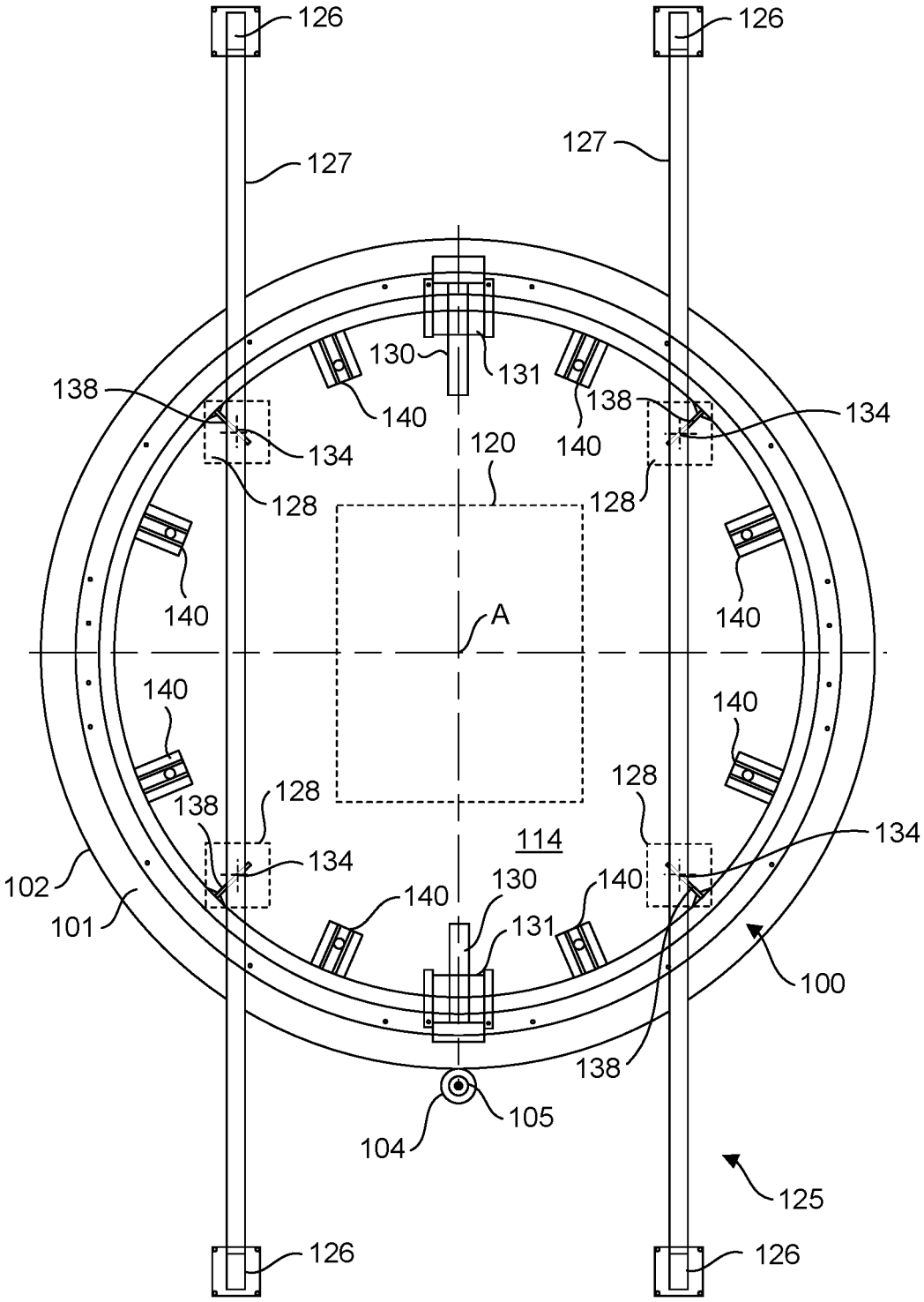
FIG. 2 is a somewhat schematic top plan view of the shoring structure assembly shown in FIG. 1.

It is apparent from the top plan view of FIG. 2 that this particular example shoring structure 100 has an outer surface having circular cross-section and thus the outer surface of the shoring structure 100 forms a cylindrical shape that extends the entire length of the structure along an assembly central axis A. The cylindrical structure shown in FIGS. 1 and 2 represents a preferred arrangement for the shoring structure 100 and its components, the base unit 106 and extension units 108, in view of the resulting strength of the configuration. However, the invention is not limited to shoring structures having a cylindrical outer surface. As will be described further below in connection with the more detailed views of the base unit 106 and extension units 108, each of these units include a wall outer surface extending parallel to the central axis A, and defining the maximum dimension of the structure along any line perpendicular to and intersecting the central axis A. In other words, the wall outer surface of the entire assembly includes no transverse ledges (transverse to central axis A) or other features that could catch on the excavation wall 102 or material collapsed inwardly from the excavation wall 102 to increase the force needed to install or remove the shoring structure 100 from the excavation 101.

The diameter of the cylindrical structure shown for example in FIGS. 1 and 2 may have a dimension over 20 feet for example, providing a large volume 114 (FIG. 2) within the shoring structure 100 for performing the desired construction, maintenance, or other activities. In view of the size of the base unit 106 and extension units 108, each of these units may be formed in two or more sections that are connected together to form the complete unit. The example of FIG. 1 shows lines 115 that each represent a joint between sections of the respective base or extension unit. The units 106 and 108 are connected together in this example structure 100 so that adjacent units are rotated ninety degrees with respect to each other about axis A so that the joint line 115 is not visible for some of the extension units 108 in FIG. 1.

Both FIGS. 1 and 2 show a dashed box 120 that represents a structure that may be within the excavation 101 and is the object of the work to be conducted within the excavation. Although the example structure is shown by rectangular box 120 it will be appreciated that the structure may be circular or irregularly shaped and may or may not be centered within the excavation as shown in the example plan view. It will be apparent from FIGS. 1 and 2 that the shoring structure volume 114 provides room for work around the structure represented by dashed box 120. The wall formed by the shoring structure 100 protects this working volume from material that could fall or collapse from the excavation wall 102.

The example shoring structure 100 is shown in FIGS. 1 and 2 with a hoist system 125. Hoist system 125 is shown here as including two sets of two support uprights 126, each set supporting a hoist beam 127. Each hoist beam 127 extends over the shoring structure 100 and excavation 101 and carries hoists 128 that may be used in the shoring structure installation and extraction processes as will be described further below. Also shown in FIGS. 1 and 2 are fall prevention systems 130 mounted on the shoring structure 100 along with ladders 131 (visible in the plan view of FIG. 2) mounted on the shoring structure for ingress to and egress from the volume 114 of the structure. The plan view of FIG. 2 shows the hoists 128 schematically as a respective box with crosshairs 134 within each box showing the position of the hoist cable or chain 135 visible in FIG. 1 extending downwardly from the respective hoist 128 into the volume 114 of the shoring structure 100. The plan view of FIG. 2 also shows lifting lugs 138 and jacking lugs 140 that are included on the base unit 106 of the shoring structure 100. These lifting lugs 138 and jacking lugs 140 will be described further below in connection with the more detailed views of the base unit 106.

It will be appreciated that the hoist system 125 shown for example in FIGS. 1 and 2 is simply an example of a system that may be used in the process of installing and extracting a shoring structure 100 in accordance with the present invention. Any other hoisting arrangement may be used as needed in the installation and extraction process. For example, rather than the hoist structure 125 shown in FIGS. 1 and 2, one or more mobile cranes may be used in accordance with the installation and extraction processes described further below. However, a hoist system such as that shown in FIGS. 1 and 2 or some other structure including cross beams over the shoring structure 100 may have an advantage in the installation jacking process described below in connection with FIG. 21.

Figure 3:
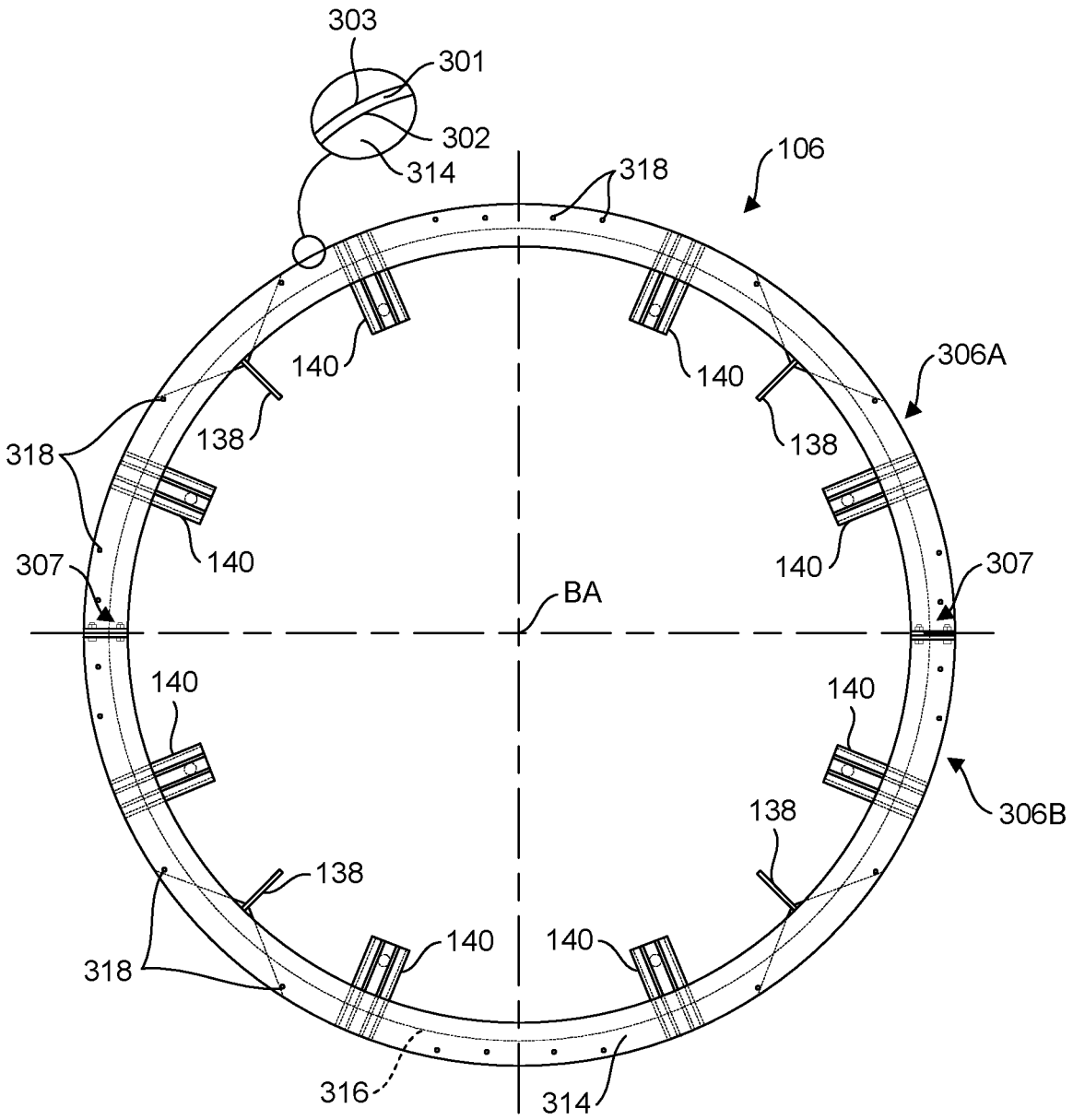
FIG. 3 is a top plan view of a base unit in accordance with aspects of the present invention.

Referring now to FIG. 3 (as well as FIGS. 4 through 12), the base unit 106 defines a base unit wall 301 having a wall inner surface 302 defining the volume of the base unit and an outwardly facing wall outer surface 303. An upper edge 304 of the base unit wall 301 along with a lower edge 305 of the base unit wall are shown in the elevation views of portions of base unit 106 including the views of FIGS. 4 and 6 for example.

Figure 10:
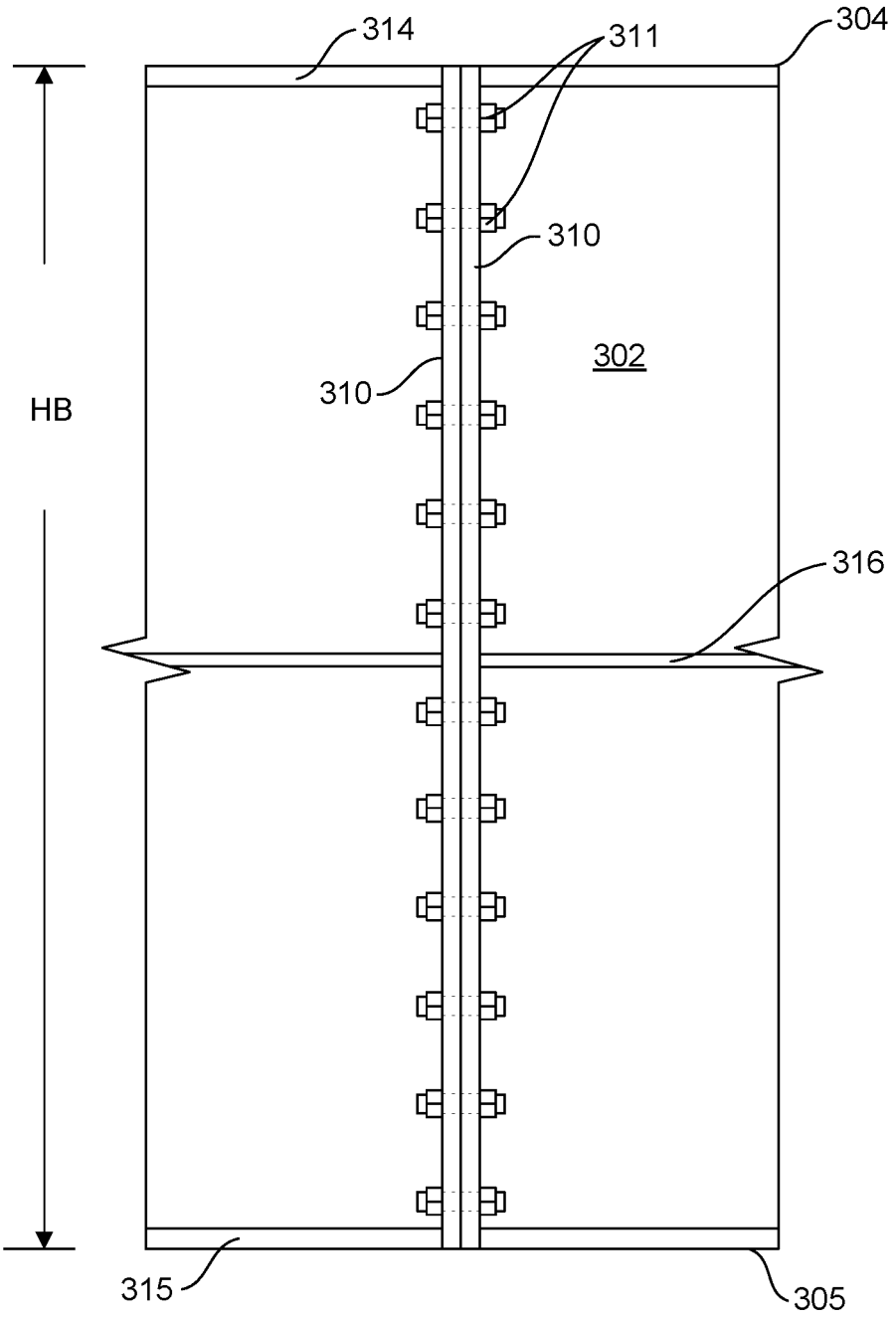
FIG. 10 is a front elevation view of a section connecting flange of the base unit shown in FIG. 3.
Figure 11:
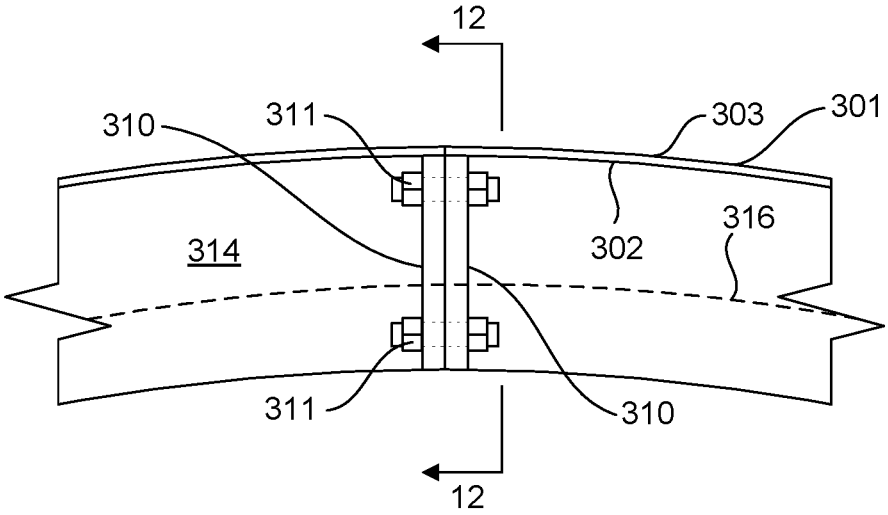
FIG. 11 is a top plan view of the section connecting flange shown in FIG. 10.
Figure 12:
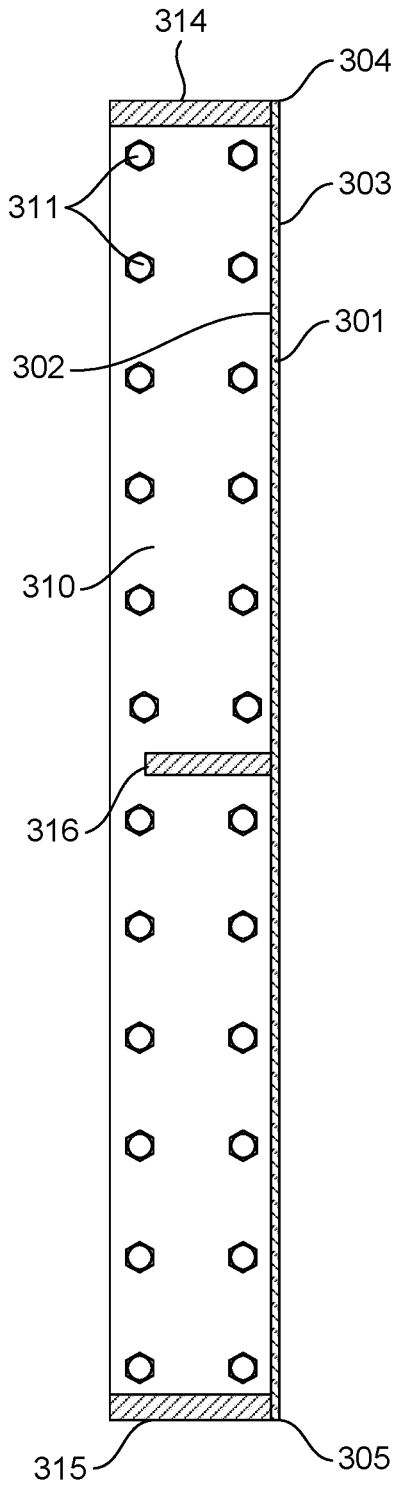
FIG. 12 is a section view taken along line 12-12 in FIG. 11.

As shown best in the plan view of FIG. 3, this example base unit is formed in two separate sections 306A and 306B each providing approximately 180° of the structure about base unit central axis BA and being connected at vertical joints shown generally at 307. Forming a large base unit into such sections facilitates transport of the device in sections to and from a job site. Other embodiments of a base unit in accordance with the present invention may not be formed in sections or may include more than two sections. The connections between the sections 306A and 306B shown in the example of FIG. 3 are each made with connecting flanges mounted on each section at the end of the base unit wall 301 defined by that section. This connecting flange arrangement is shown in FIGS. 10 through 12. Each connecting flange 310 comprises a plate of material connected along one edge to the base unit wall inner surface 302 and extending in a plane perpendicularly to the surface 302 at that point. In this particular example, each flange 310 extends along the entire height dimension HB of the base unit (shown in FIG. 10) and is connected to the complementary flange 310 of the other base unit section through two columns of bolts 311.

The particular example base unit 106 shown in FIGS. 3 through 12 includes three separate stiffening rings each comprising plate material connected to the base unit inner wall 302 and extending into the base unit volume. These different stiffening rings are perhaps best shown in the front elevation and section views of the base unit, including the views of FIGS. 10 and 12 for example. Referring to FIGS. 10 and 12, an upper stiffening ring 314 has an upper surface aligned with the base unit wall upper edge 304 in this example embodiment, whereas the lower stiffening ring 315 has a lower surface aligned with the lower edge 305 of the base unit wall 301. An intermediate stiffening ring 316 in this example embodiment is located approximately halfway along the height dimension HB of the base unit. Although the invention is not limited to the configuration of the stiffening rings shown in the example base unit 106 and is not limited to the location of the stiffening structures on the base unit, the upper and lower stiffening rings 314 and 315, respectively, in this illustrated embodiment provide a convenient location for connecting elements that may be used to connect the base unit 106 to other components of the shoring structure (100 in FIGS. 1 and 2). In the example base unit 106 shown in FIGS. 3 through 12, these connecting elements comprise bolt holes 318, each for receiving a suitably sized bolt to form the desired connection. These bolt holes 318 in the upper stiffening ring 314 are visible in the plan view of FIG. 3 and are positioned to align with corresponding bolt holes on an extension unit 108 as will be described further below. A similar arrangement of bolt holes in lower stiffening flange 315 may be provided as connecting elements to facilitate the connection between the base unit 106 and extraction shield 109 described further below in connection with FIGS. 16 and 17.

Figure 4:
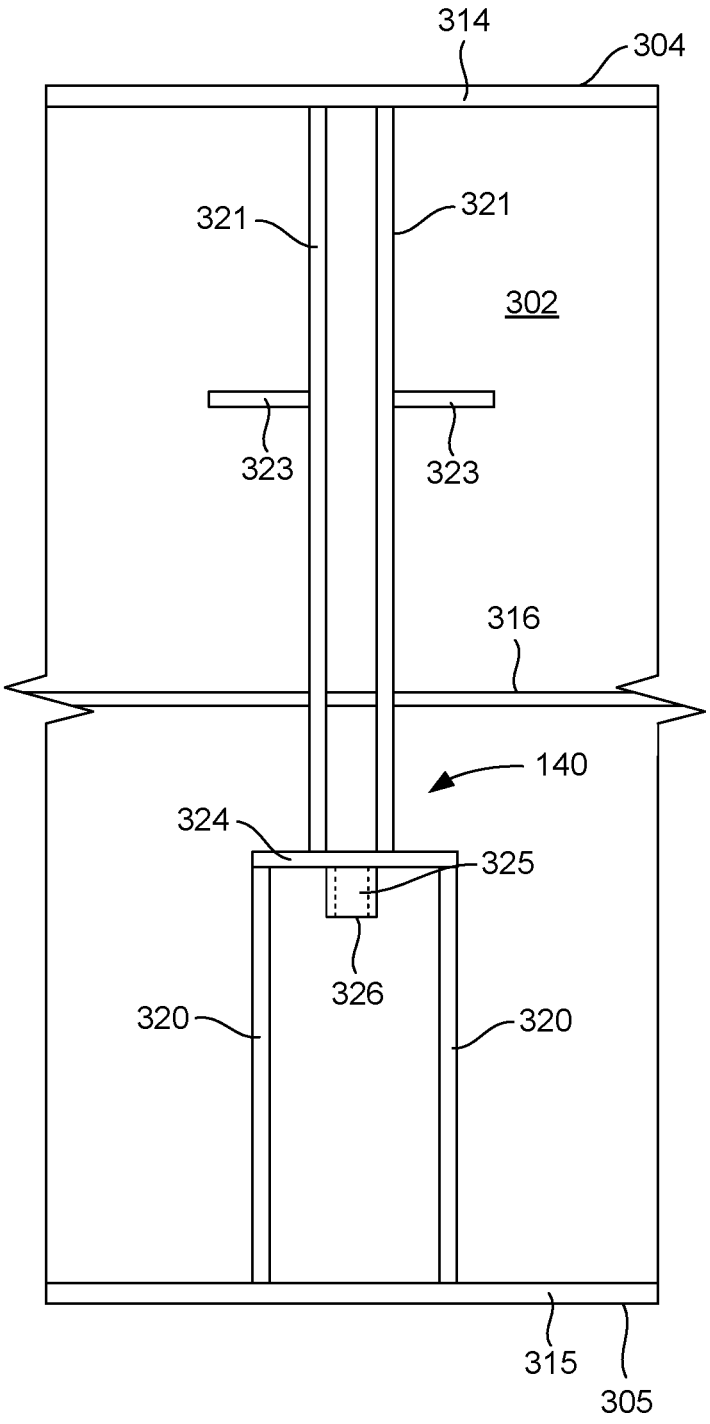
FIG. 4 is a front elevation view of a jacking lug of the base unit shown in FIG. 3.
Figure 5:
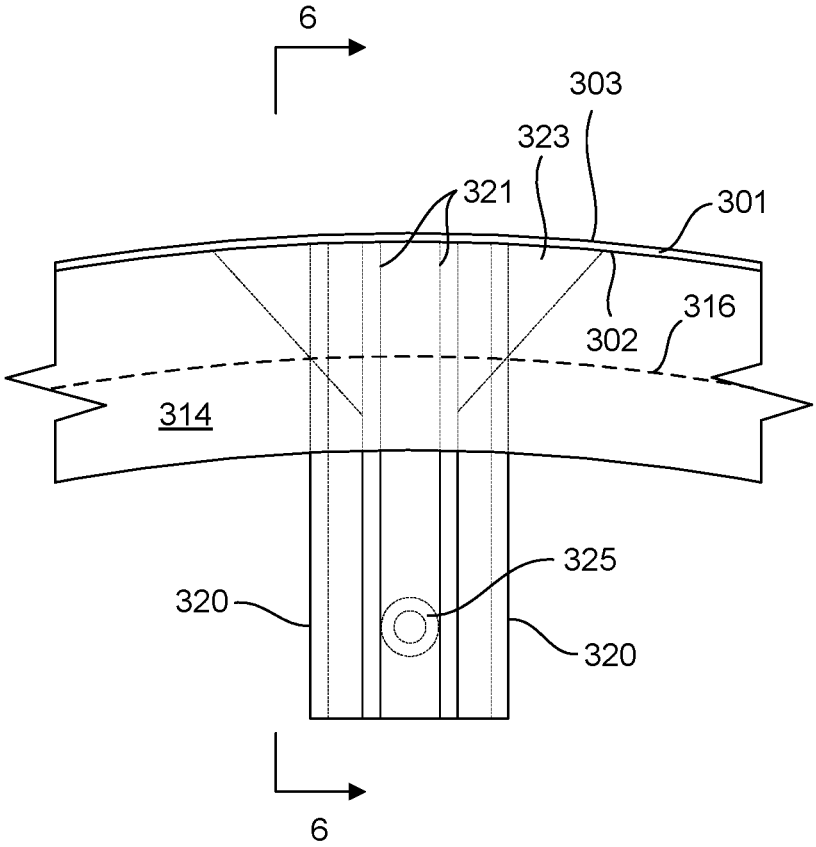
FIG. 5 is a top plan view of the jacking lug shown in FIG. 4.
Figure 6:
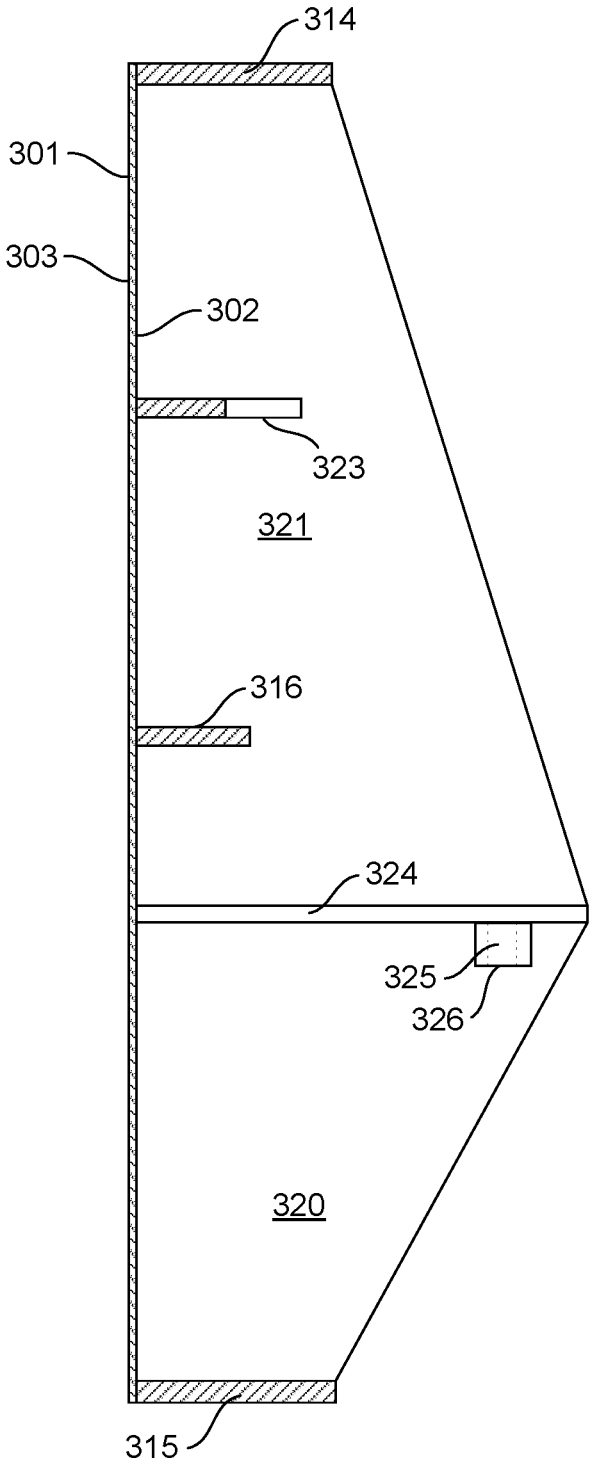
FIG. 6 is a section view taken along line 6-6 in FIG. 5.

Although a base unit within the scope of the present invention may include as few as two jacking lugs 140, the example base unit 106 shown in FIG. 3 includes eight jacking lugs 140 equally spaced apart about the base unit central axis BA. The number of jacking lugs included in a particular implementation will depend primarily upon the amount of force that is expected to be required in extracting the shoring structure from the excavation in the processes described below in connection with FIGS. 18 through 20. As will be described in connection with those figures, the jacking lugs 140 will in any event provide a jack receiver that is adapted to receive an end of a jacking device arranged to apply an extraction jacking force in a direction from the base unit wall lower edge 305 to the base unit wall upper edge 304. FIGS. 4 through 6 show an example jacking lug structure for jacking lug 140 that may be used in embodiments of the base unit 106 according to the present invention. Each jacking lug 140 in this example comprises two parallel lower plates 320 and two parallel upper plates 321. Each of the two upper plates 321 is directly connected to the base unit inner wall surface 302 and to the lower surface of the upper stiffening ring 314 in this example, while each of the lower plates 320 is directly connected along one edge to the base unit inner wall surface 302 and along another edge to the upper surface of the lower stiffening ring 315. With reference particularly to the view of FIG. 4, the right hand side lower plate 320 and right hand side upper plate 321 together provide a first elongated connection directly to the base unit wall inner surface 302 while the left hand side lower plate 320 and left hand side upper plate 321 together provide a second elongated connection directly to the base unit wall inner surface 302. Upper plates 321 each have a respective elongated upper plate connection to the base unit wall inner surface 302 and lower plates 320 each have a respective elongated lower plate connection to the base unit wall inner surface 302. The two upper plates 321 are reinforced by gussets 323 in this example. The arrangement of upper plates 321 and lower plates 320 support a jacking lug plate 324 that is connected at one end to the base unit wall inner surface 302 and extends in this example perpendicularly to the base unit wall inner surface 302 and base unit central axis BA (in FIG. 3). This jacking lug plate 324 provides a location for the jack receiver 325 that in this example comprises a cylindrical tube having an open end 326 facing downwardly from a lower surface (a jacking lug receiver surface) of the jacking lug plate 324.

Figure 7:
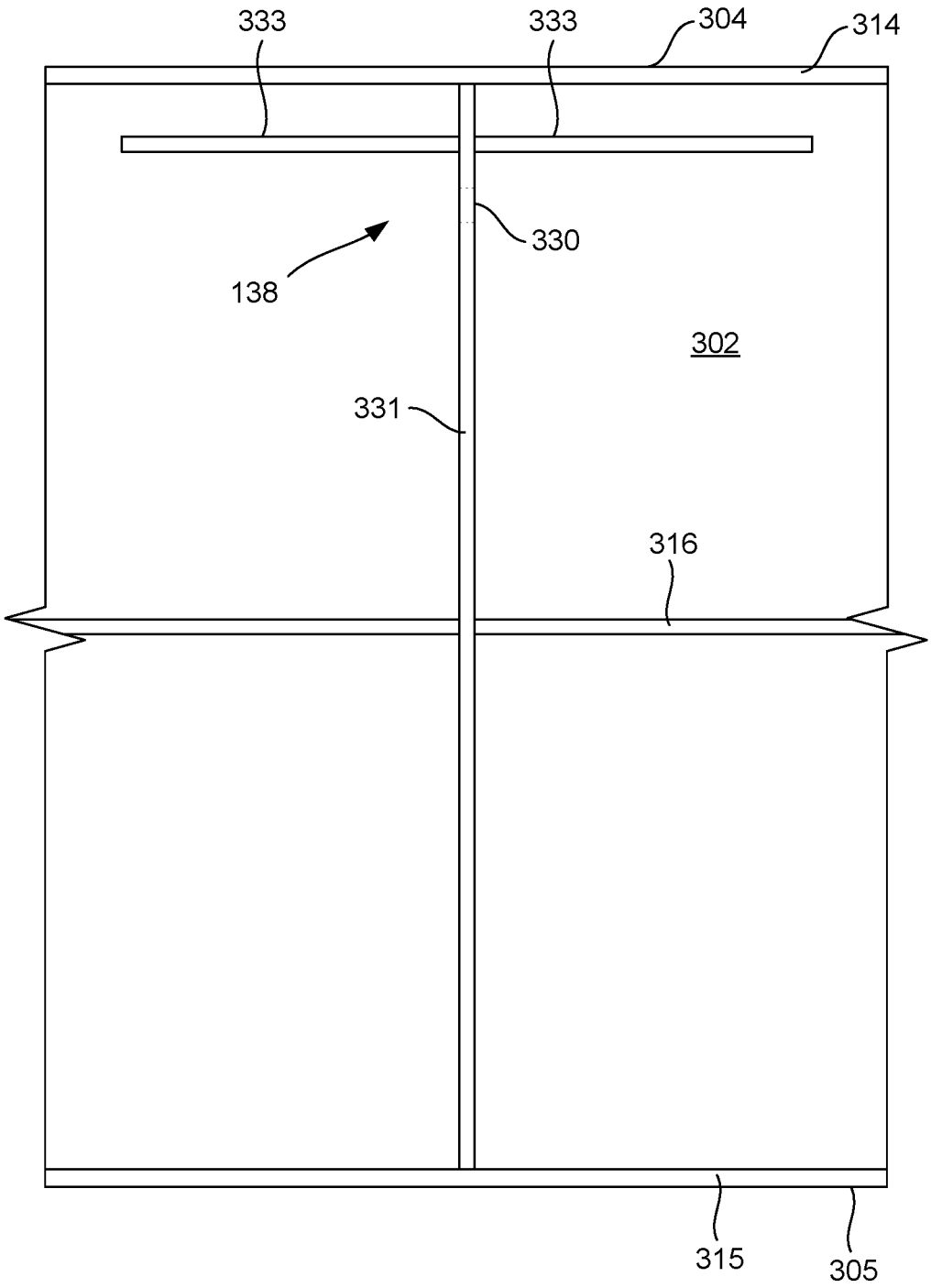
FIG. 7 is a front elevation view of a lifting lug of the base unit shown in FIG. 3.
Figure 8:
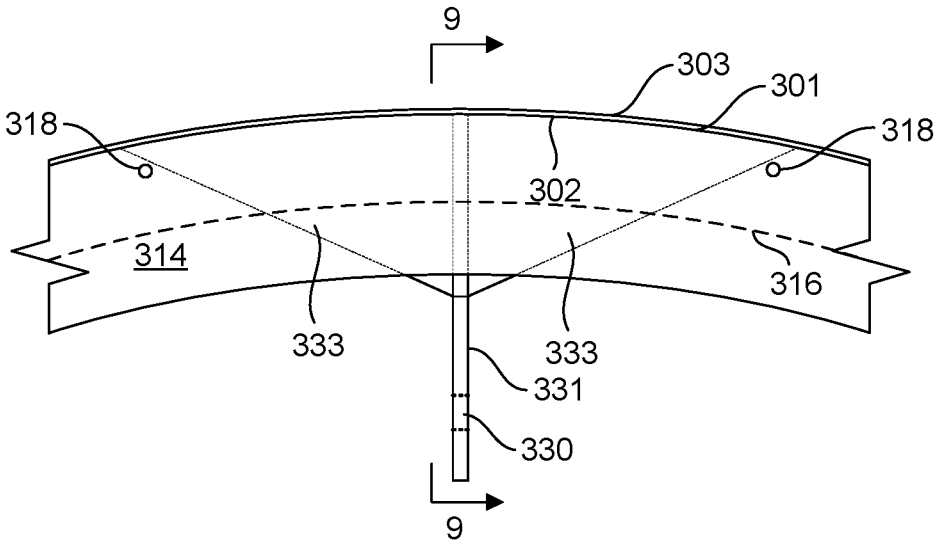
FIG. 8 is a top plan view of the lifting lug shown in FIG. 7.
Figure 9:
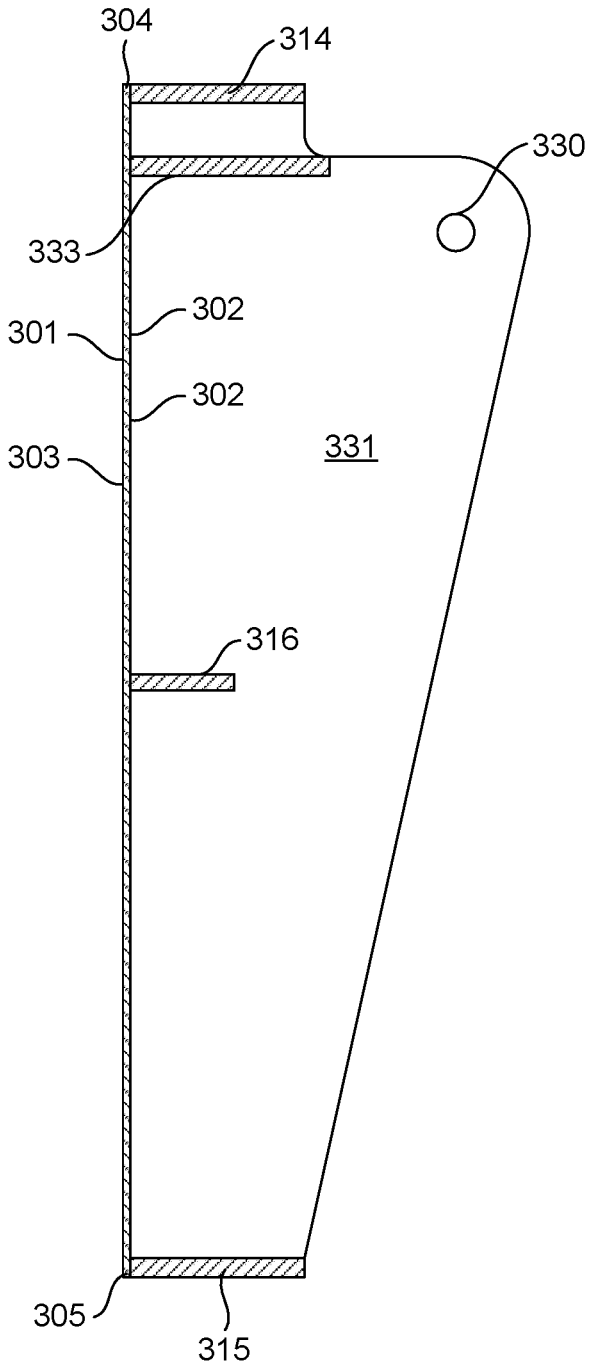
FIG. 9 is a section view taken along line 9-9 in FIG. 8.

Each lifting feature included on the example base unit shown in FIGS. 3 through 12 comprises a lifting eye 330 included on a lifting lug 138. Although embodiments of a base unit in accordance with the invention may include as few as two lifting features, the example base unit shown in FIG. 3 includes four lifting features each associated with a respective lifting lug 138. The enlarged views of FIGS. 7 through 9 show that the example lifting lug 138 comprises a lifting lug plate 331 connected along one edge to the base unit wall inner surface 302 and extending perpendicularly to that surface into the base unit volume. The example lifting lug plate 331 is also connected at an upper edge to the lower surface of the upper stiffening ring 314 and is connected at a lower edge to the upper surface of the lower stiffening ring 315, and also connected to the intermediate stiffening ring 316 that protrudes into a slot formed on the lifting lug plate 331 as shown best in FIG. 9. The example lifting lug plate 331 is supported or reinforced near its upper end by gussets 333 that connect to the lifting lug plate and to the base unit wall inner surface 302. The lifting eye 330 in this example is formed near a top of the lifting lug plate 331 and spaced apart from the base unit wall inner surface 302.

Figure 13:
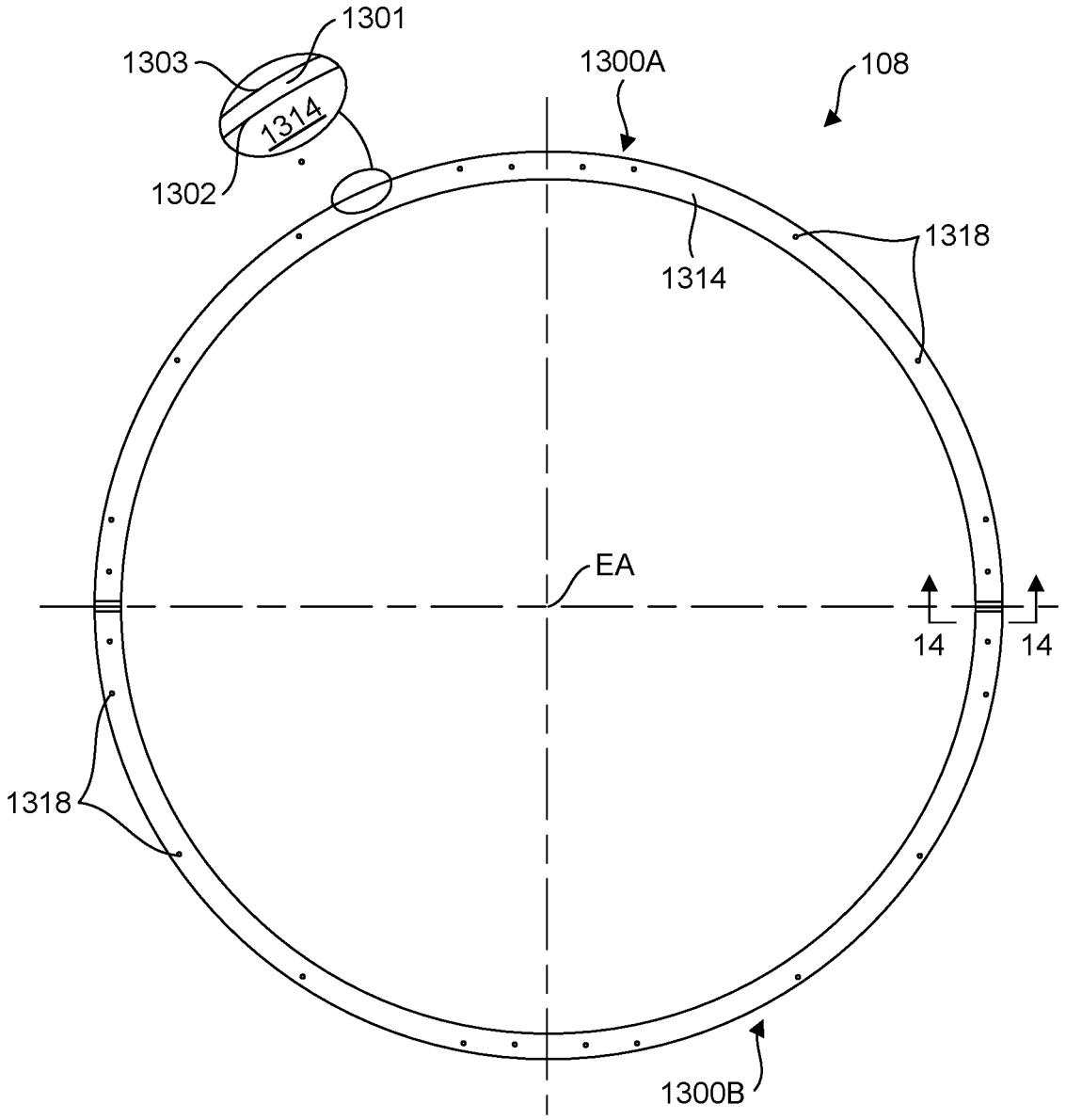
FIG. 13 is a top plan view of an extension unit in accordance with aspects of the invention and configured for use with the base unit shown in FIGS. 3-12.
Figure 14:
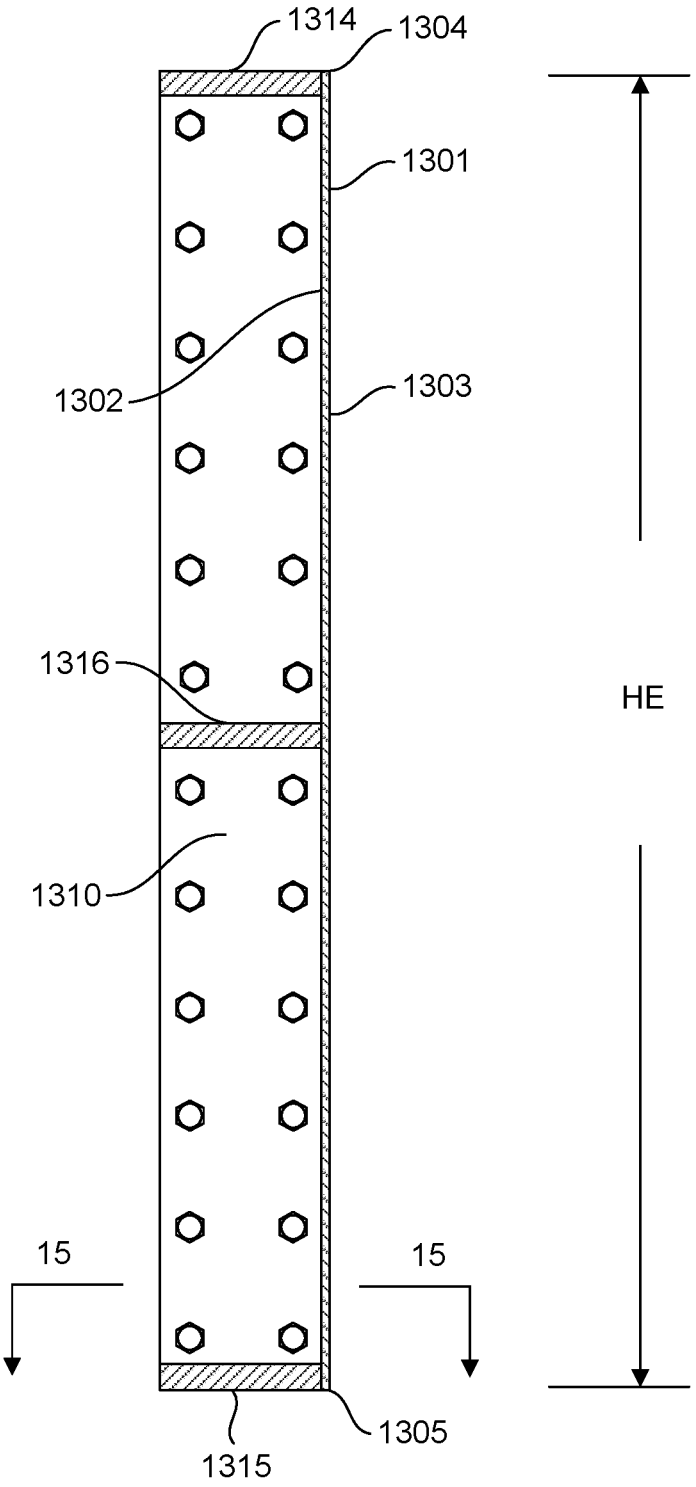
FIG. 14 is a section view taken along line 14-14 in FIG. 13.
Figure 15:
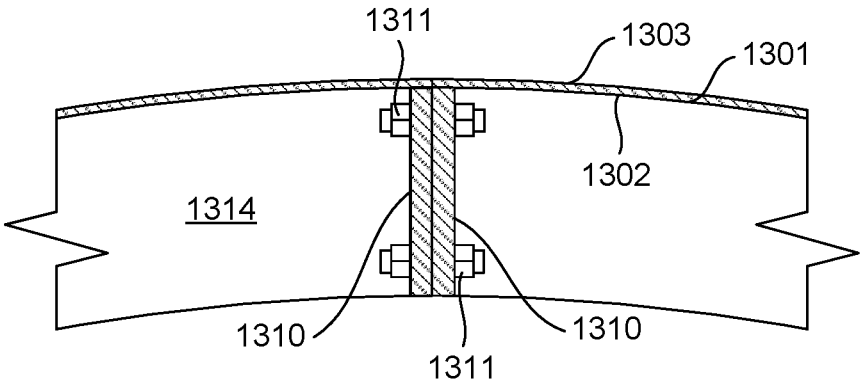
FIG. 15 is a section view taken along line 15-15 in FIG. 14.

FIGS. 13 through 15 show an example extension unit 108 that may be employed in implementations of the invention. As shown particularly in the FIG. 13, this example extension unit 108 is formed in two sections 1300A and 1300B similarly to the example base unit 106 shown in FIG. 3 to facilitate transport to and from a job site. As with the base unit 106, an extension unit 108 within the scope of the present invention may be formed in more sections or may be formed as a unitary device. In any event, the extension unit 108 defines an extension unit wall 1301 that includes an extension unit wall inner surface 1302 and an extension unit wall outer surface 1303. The extension unit wall inner surface 1302 defines the volume of the extension unit. The joints that connect the two sections 1300A and 1300B of example extension unit 108 may comprise any suitable joint structure and including a connecting flange arrangement similar to that shown in FIGS. 10 through 12 in connection with the base unit 106. In particular, the section views of FIGS. 14 and 15 show that each section 1300A and 1300B includes a connecting flange 1310 comprising a plate of material connected along one edge to the extension unit wall inner surface 1302 and extending in a plane perpendicularly to the surface 1302 at that point. Each flange 1310 extends along the entire height dimension HE (shown in FIG. 14) of the extension unit 108 and is connected to a complementary flange of the other extension unit section through two columns of bolts 1311. Also, the example extension unit 108 shown in FIGS. 13-15 includes stiffening rings 1314, 1315, and 1316 corresponding to stiffening rings 314, 315, and 316, respectively, shown for example in FIGS. 10 and 12 in connection with the base unit 106. The top plan view of FIG. 13 shows connecting features on the upper stiffening ring, in this case bolt holes 1318 that are configured to align with corresponding features on the lower stiffening ring of an adjacent extension unit in order to connect the two extension units together. Additional connecting features 1318 are formed on the lower stiffening ring 1315 and are configured to align with the connecting features 318 on the upper stiffening ring 314 of the base unit 106 for connecting the extension unit 108 to the base unit 106.

Figure 16:
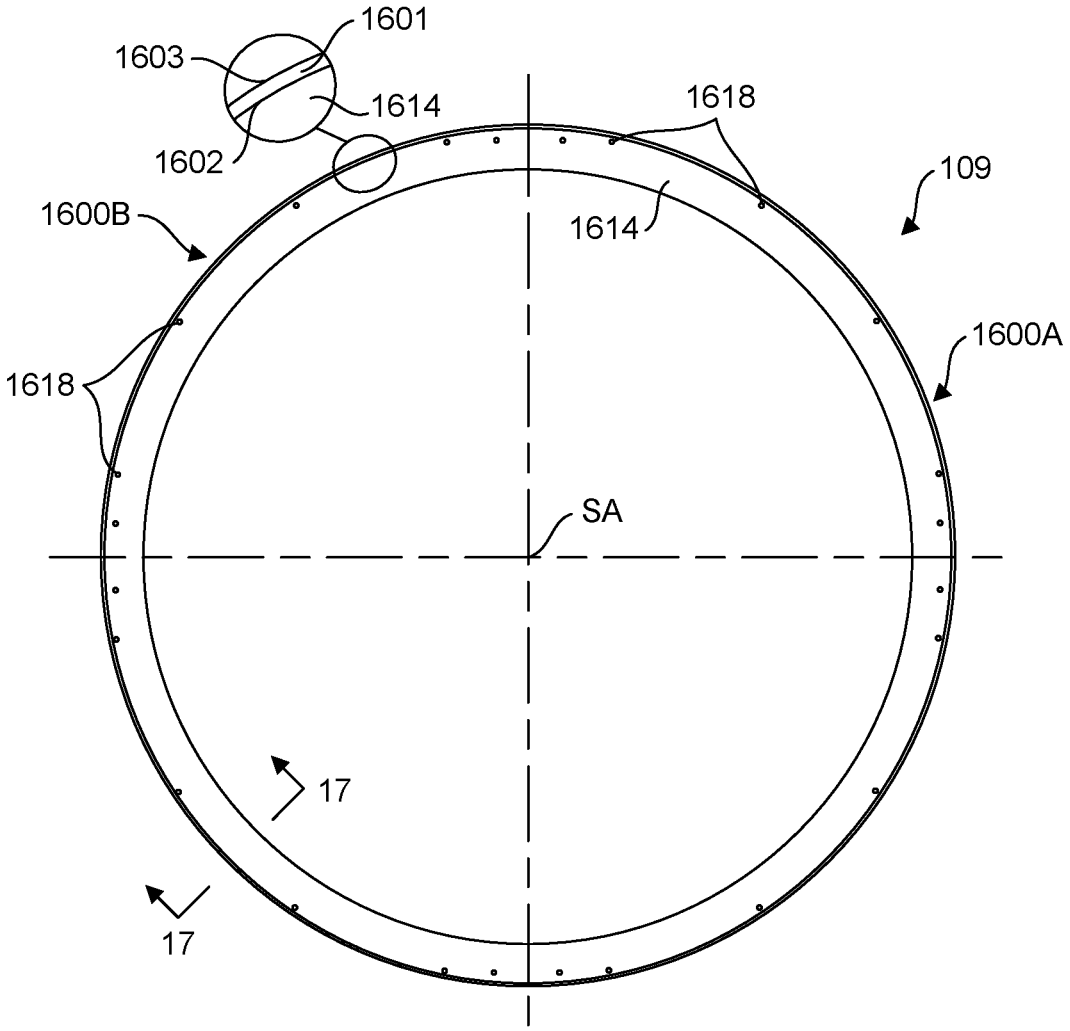
FIG. 16 is a top plan view of an extraction shield in accordance with aspects of the invention and configured for use with the base unit shown in FIGS. 3-12.
Figure 17:
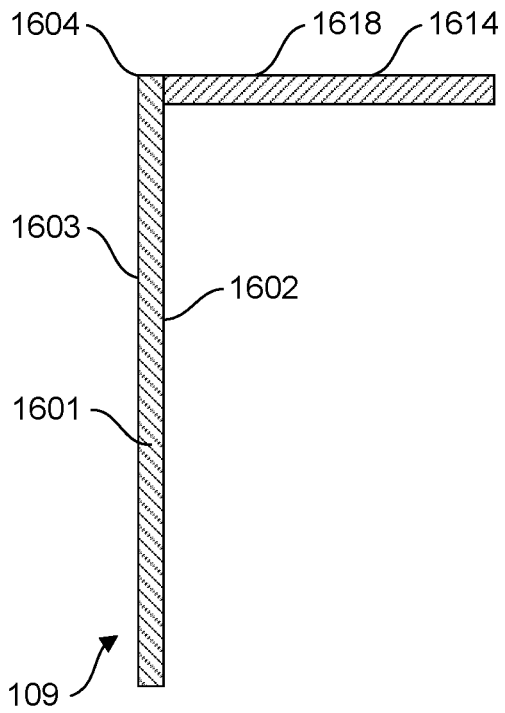
FIG. 17 is a section view taken along line 17-17 in FIG. 16.

FIG. 16 shows a top plan view of an extraction shield 109 such as that shown in the example shoring structure 100 of FIG. 1. As will be discussed below in connection with the processes of extracting a shoring structure in accordance with aspects of the invention, the extraction shield is useful in situations where the excavation is through material that is prone to collapse into the excavation as the shoring structure is removed. The illustrated extraction shield 109 includes a shield wall 1601 centered on shield axis SA and having a shield wall inner surface 1602 defining the volume of the extraction shield and a shield wall outer surface 1603 facing away from the volume of the extraction shield. As with the base unit 106 and extension unit 108, the illustrated extraction shield 109 is formed in two sections 1600A and 1600B. These sections are not connected by a flange however. A connecting/stiffening ring 1614 is located at a top edge 1604 of the extraction shield wall 1601 and provides a location for bolt holes 1618 by which the extraction shield may be connected to the lower stiffening ring 315 of the base unit 106 (e.g., FIGS. 10 and 12). Unlike the base unit 106 and extension unit 108, there is no stiffening or connecting ring mounted at the lower edge of the extraction shield 109. Rather, the extraction shield inner wall surface 1602 includes no protuberances or features that extend from that wall into the volume of the extraction shield. The purpose of this configuration will be apparent in the discussion below regarding the shoring structure extraction process using the extraction shield.

Figure 18:
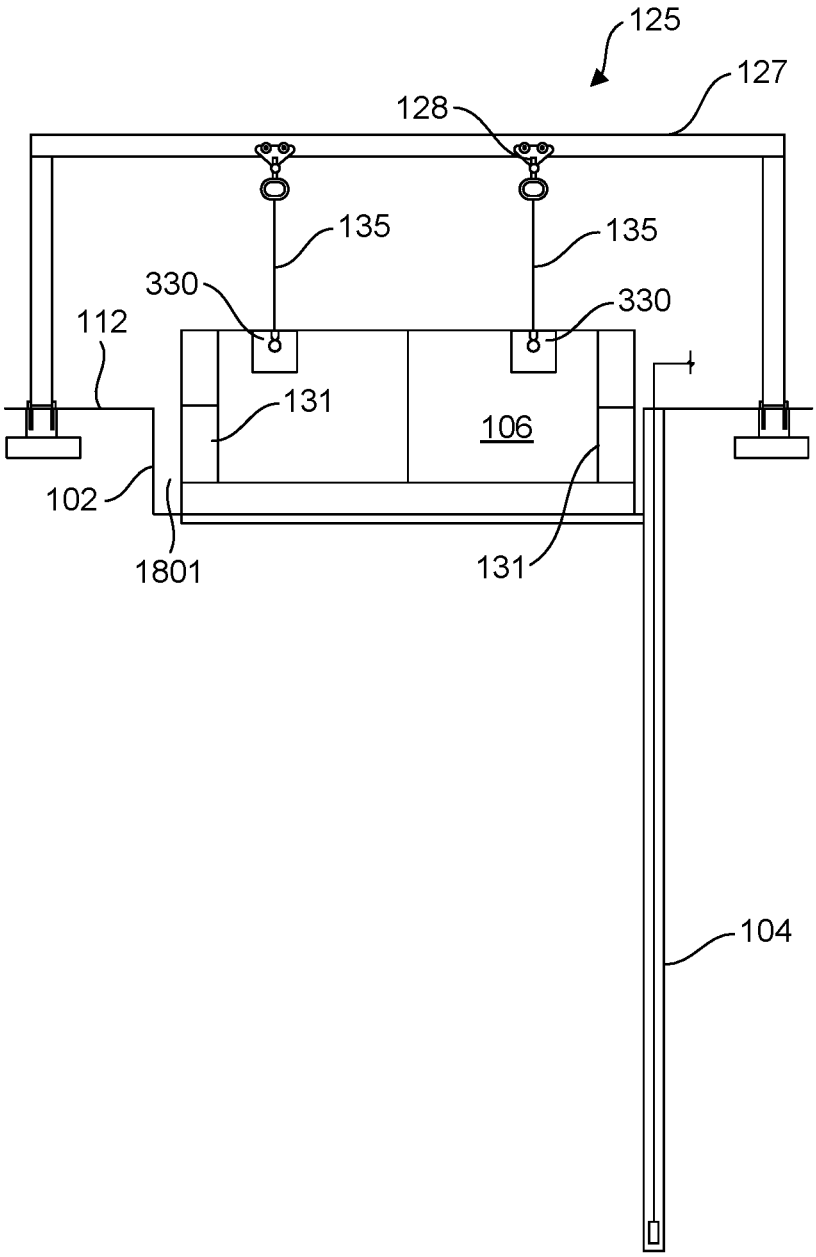
FIG. 18 is a somewhat schematic representation showing a base unit and extraction shield lowered into an initial surface excavation in a process of installing a shoring structure in accordance with an aspect of the present invention.

Processes by which a shoring structure such as that shown in FIGS. 1 and 2 may be installed in an excavation may be described with references to FIGS. 18 through 21. Referring first to FIG. 18, the process includes making a first excavation 1801 down to a level in which the base unit 106 may be lowered at least partially below surface level 112. It will be appreciated that the perimeter of the first excavation 1801 will be sufficient to accommodate the width of the base unit 106 in each direction horizontally with suitable space left between the base unit wall outer surface 303 and the wall 102 of the excavation. Also, the first excavation 1801 may be made with a suitable excavator prior to placing the base unit 106 over the location of the first excavation. Once the first excavation is at least partially completed, the base unit 106 may be lowered into the excavation using a hoisting system such as system 125. Each hoist cable/chain 135 may be connected at its lower end to a respective lifting feature associated with the base unit such as a lifting eye 330 as described above (the lifting eyes 330 are shown schematically in FIGS. 18-24). Where a dewatering system is required, the dewatering shaft is placed so that it will reside adjacent to the excavation perimeter to the desired depth for the final depth of the excavation, and may be installed prior to making the first excavation 1801.

With the base unit 106 remaining at least partially in the first excavation volume roughly in the position shown in FIG. 18, the process includes excavating further to deepen the excavation to a second excavation volume. This second excavation involves holding the base unit 106 for example in the position shown in FIG. 18 using hoisting system 125 or otherwise and then excavating from within the volume of the base unit to deepen the excavation. This will include excavating under the base unit wall out to a desired distance beyond the base unit wall outer surface 303 to provide the desired excavation perimeter. As the excavation continues using appropriate excavating equipment within the volume of the base unit and with the excavation spoils removed from the base unit 106 in any suitable manner, the base unit 106 may be lowered further into the deepened excavation but still leaving sufficient room from the bottom of the excavation so that the desired width of the excavation may be reached working from within the volume of the base unit 106.

Figure 19:
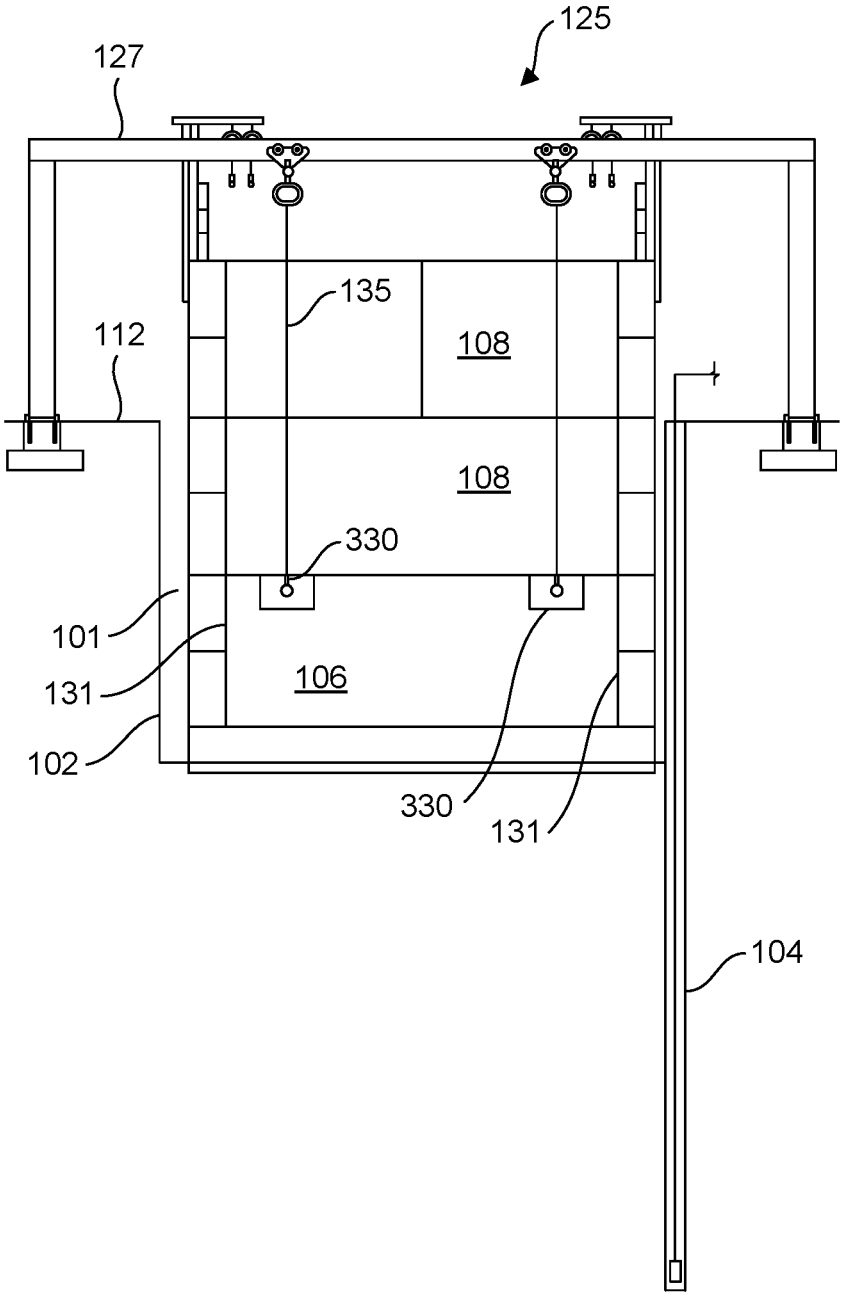
FIG. 19 is a somewhat schematic representation similar to FIG. 18 but showing the base unit connected to two extension units and lowered into a deepened excavation in a process of installing a shoring structure.

The installation process further includes connecting an extension unit 108 to the base unit 106 preferably once the excavation reaches a desired depth to allow the added extension unit 108 to be accommodated under hoist beams 127. This connection of an extension unit 108 may or may not require disconnecting the hoist cables/chains from the lifting features 330 of the base unit 106. In any event the added height provided by the connected extension unit 108 allows the shoring structure made up of the combination of base unit 106 and extension unit 108 to be lowered further while still maintaining the upper edge of the extension unit 108 above surface level 112 to protect the excavation as it is being created. FIG. 19 illustrates a point at which a first extension unit 108 has been connected to the base unit 106 and the resulting combination of base unit 106 and the first extension unit 108 lowered further into the excavation as it is created with an additional extension unit 108 connected to the top of the first extension unit. The excavation can be continued in this fashion excavating at the bottom of the excavation and under the wall of the base unit 106 with the combination of base unit and extension units being lowered further periodically and additional extension units added periodically until the desired full excavation depth is achieved. In the final fully installed position such as that shown for example in FIG. 20 in which a total of five additional extension units 108 have been added, the upper edge 1304 of the uppermost extension unit 108 preferably remains at least at desired distance above surface level 112.

Figure 20:
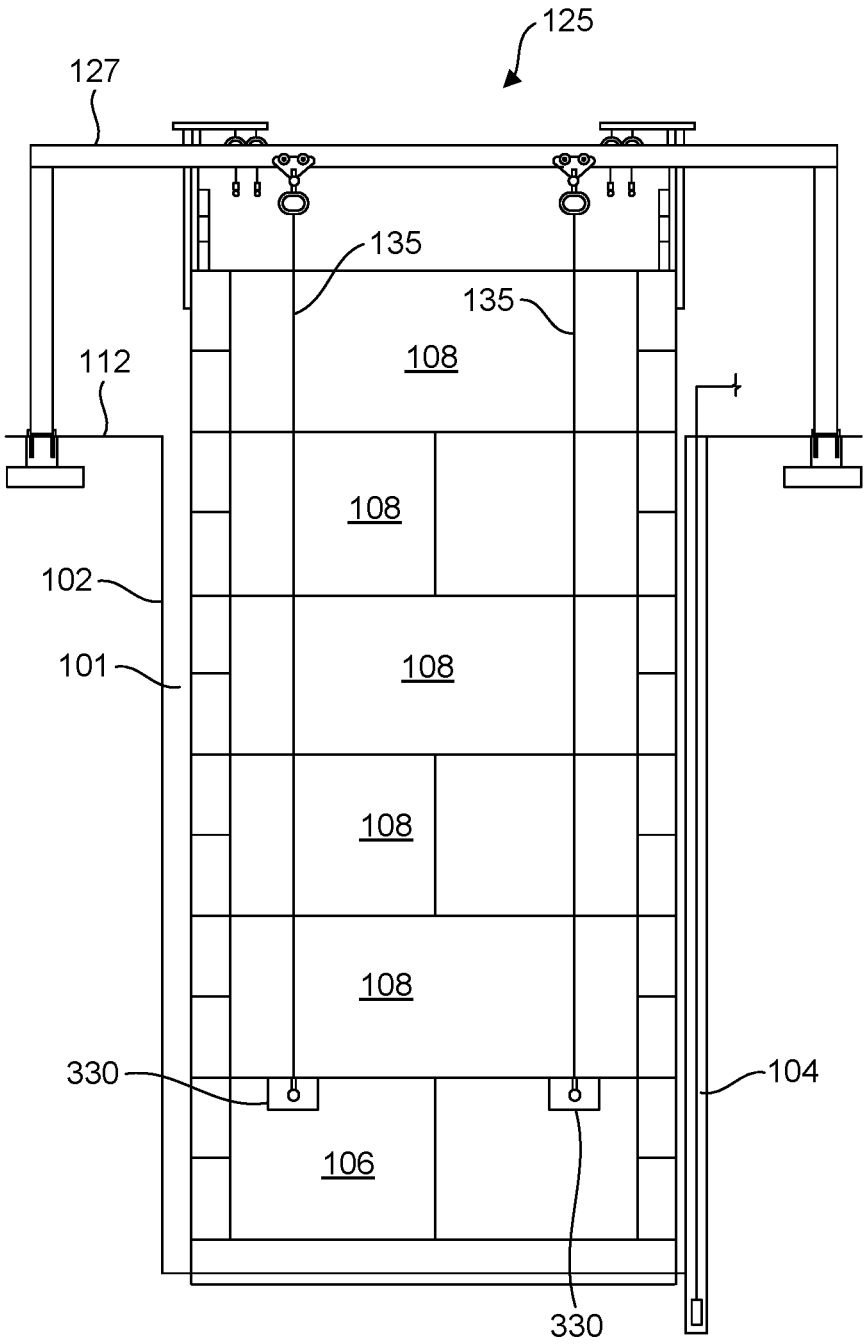
FIG. 20 is a somewhat schematic representation similar to FIG. 19 but showing the base unit connected to three additional extension units as compared to FIG. 19, and lowered into a further deepened excavation.
Figure 21:
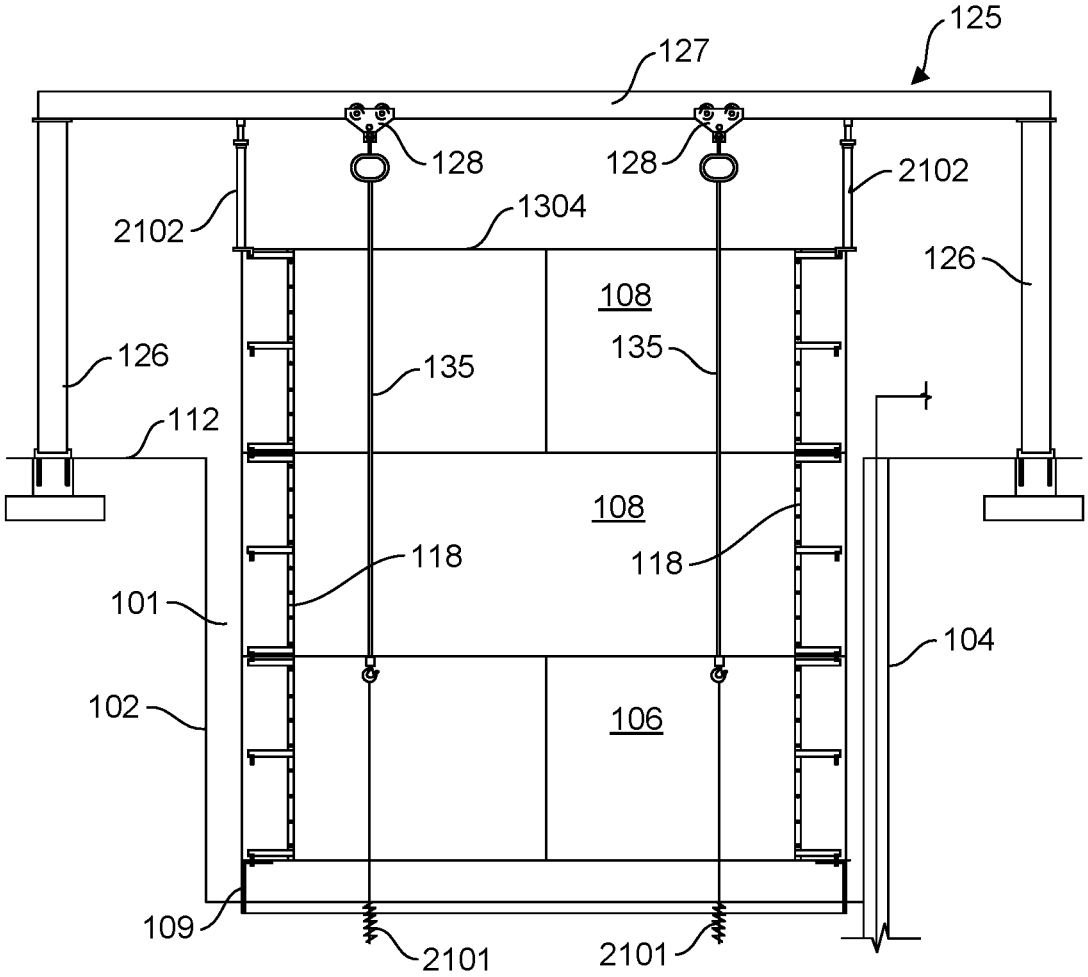
FIG. 21 is a somewhat schematic representation similar to FIG. 19 where two extension units have been connected to the base unit, and showing installation jacking devices in place for applying an installation jacking force according to an aspect of the present invention.

The process indicated by FIGS. 18 through 20 assumes that the excavation remains competent as the shoring structure, that is, the combination of base unit 106 and extension units 108, is lowered to the desired depth. In some instances, however, one or more layers of material through which the excavation must pass may include material that will readily collapse into the excavation and against the shoring structure outer surface made up of base unit wall outer surface 303 and the extension unit wall outer surface 1303 of each extension unit 108. In these cases, the weight of the base unit 106 and any extension units 108 connected above the base unit 106 may be insufficient to allow the structure to be lowered further into the excavation 101 simply under the weight of the structure. FIG. 21 shows a jacking system that may be used in these instances to apply a jacking force in addition to the weight of the structure to force the structure (base unit 106 and any connected extension units 108) further down into the excavation 101. The installation jacking system includes one or more soil bolts 2101 that may each be connected by one or more suitable connecting lines to the hoisting system 125 and two or more installation jacks 2102 positioned to operate between the hoisting system beam 127 and the wall of the uppermost extension unit. Although the diagrammatic view of FIG. 21 only two installation jacks 2102 are visible, it will be appreciated that two additional jacks 2102 may operate between a second hoist beam 127 such as that shown in FIG. 2. Alternatively, additional members may be included in the hoist structure to accommodate additional jacks 2102 acting at different points around the upper edge 1304 of the uppermost extension unit 108. In the example of FIG. 21, the two illustrated soil bolts are connected to the hoisting system 125 through the hoist cables/chains 135 that have meanwhile been disconnected from the lifting features 330 of the base unit 106. Additional soil bolts may be connected to the other hoist beam 127 of the hoist system (see FIG. 2). The soil bolts 2101 and connection to the hoist beams 127 counteract the jacking force applied by the jacks 2102 to prevent that force from lifting the hoisting structure. Thus the arrangement shown in FIG. 21 allows significant jacking force to be applied to the shoring structure made up of the base unit 106 and extension units 108 to force the structure further into the excavation 101.

The extension range of the jacks 2102 is preferably such that they may be used to jack a newly added extension unit 108 downwardly far enough to connect an additional extension unit and then retracted sufficiently to jack the structure including the newly added extension unit 108 further into the excavation. Alternatively, spacing structures may be used between jacks 2102 and the uppermost extension unit 108 to extend the effective jacking range of the jacks 2102. Of course, excavation continues to provide room in the excavation 101 for receiving the shoring structure (unit 106 and units 108) as it is jacked downwardly.

Although the example extension unit 108 described above includes only horizontal stiffing rings 1314, 1315, and 1316 to reinforce the extension unit wall 1301, additional reinforcing may be required for withstanding the installation jacking forces that may be required to drive a given shoring structure into the excavation. In these cases, vertical reinforcing plates and other structures may be mounted in the extension unit wall inner surface (1302 in FIGS. 13-15). Such vertical reinforcing structures may be located at installation jacking points spaced apart along the extension unit wall (1301 in FIGS. 13-15) within the volume of the extension unit.

Figure 22:
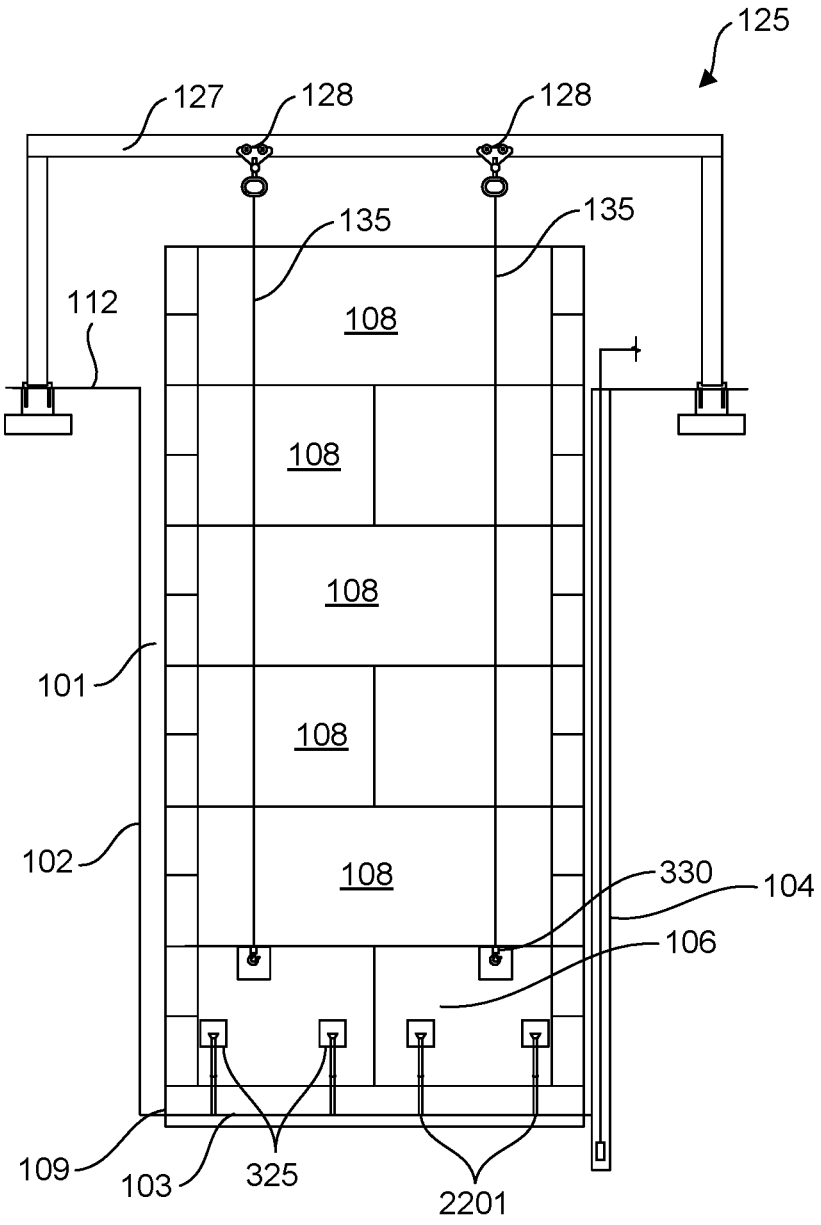
FIG. 22 is a somewhat schematic representation showing a shoring structure in an installed position in an excavation with lifting jacks in position to lift the shoring structure upwardly in accordance with an aspect of the present invention.
Figure 23:
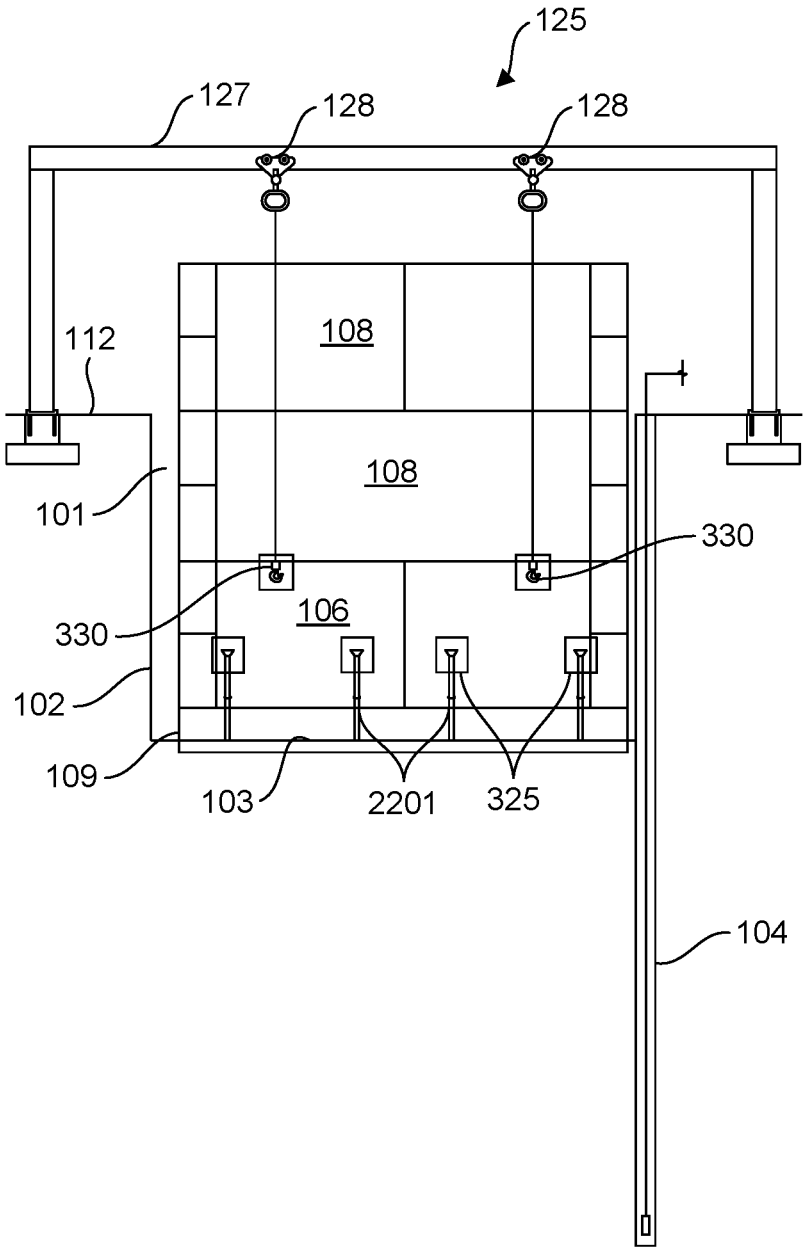
FIG. 23 is a somewhat schematic representation similar to FIG. 22 but showing the excavation partially filled and the shoring structure lifted upwardly so that only two extension units remain connected to the base unit.
Figure 24:
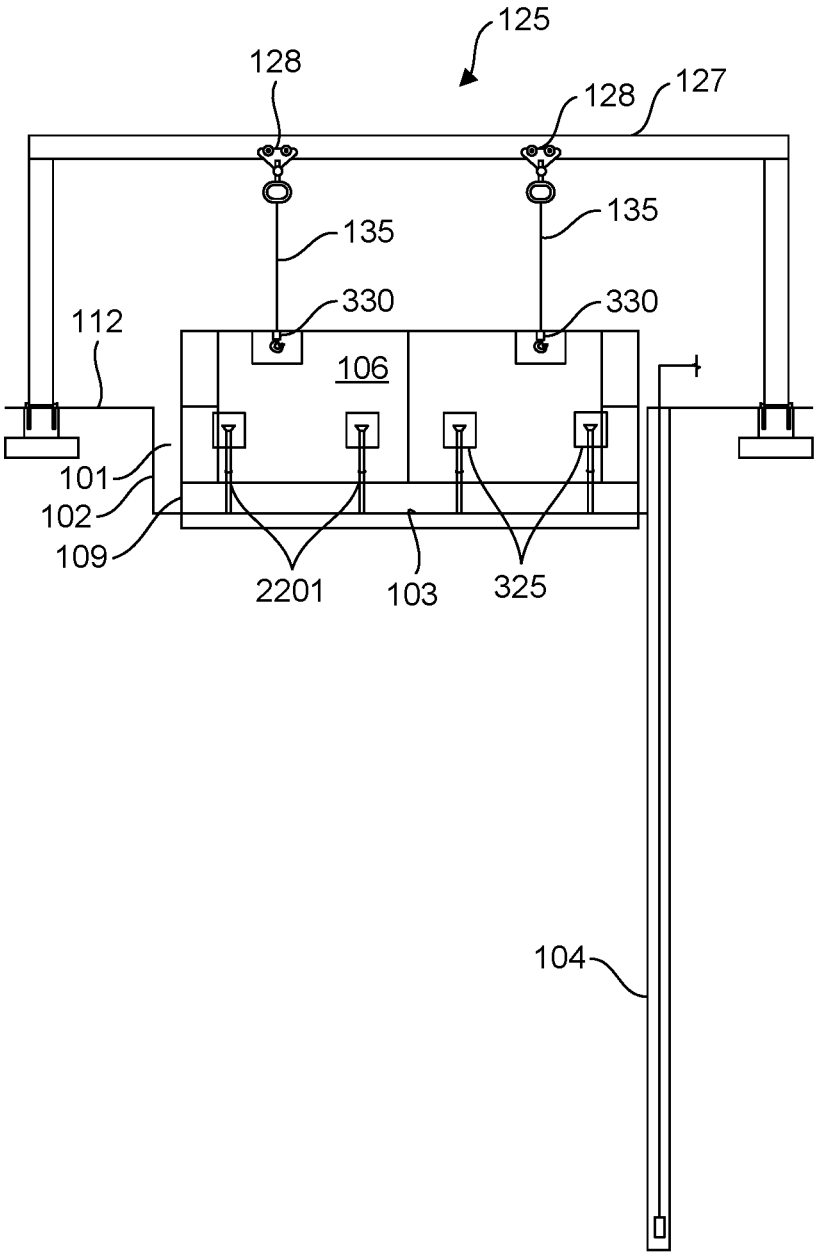
FIG. 24 is a somewhat schematic representation similar to FIG. 23 but showing the excavation further filled in with only the base unit remaining in the excavation.
Figure 25:
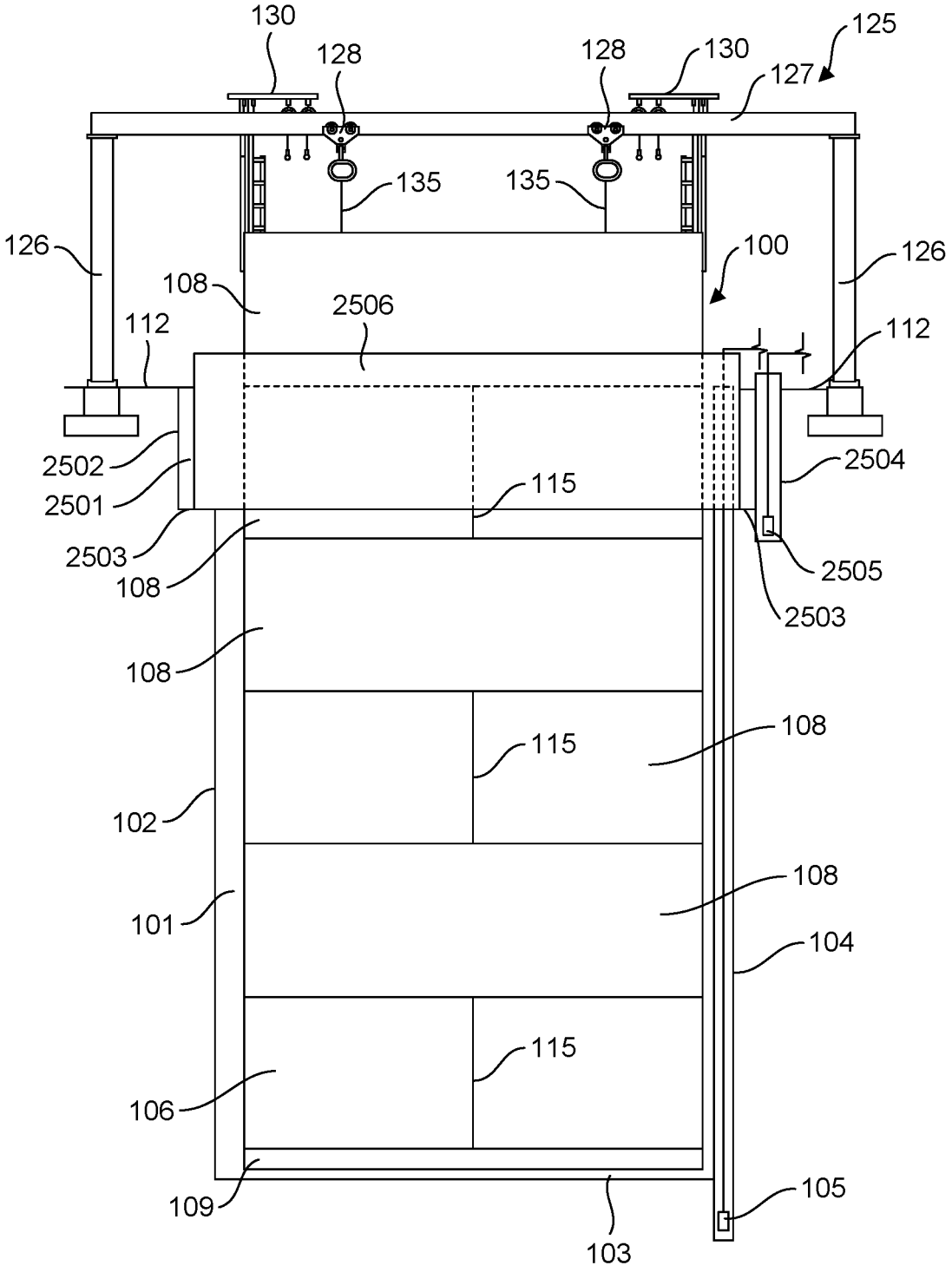
FIG. 25 is a somewhat schematic representation similar to FIG. 1 but showing an additional, larger-diameter base unit installed at the surface of the assembly.

FIGS. 22 through 24 illustrate a process by which a shoring structure made up of a base unit 106 and extension units 108 may be extracted from an excavation 101 in accordance with aspects of the invention. In some cases, the excavation wall 102 remains sufficiently intact while the shoring structure is in place so that the hoisting system 125 can simply lift the shoring structure upwardly from its installed position. Once the shoring structure has been lifted sufficiently upwardly relative to surface level 112, the uppermost extension unit 108 may be removed from the structure. Meanwhile, as the shoring structure is lifted, the excavation may be filled in below the lower edge of the base unit 106. This process of lifting the shoring structure (base unit 106 and connected extension units 108) upwardly and filling in the excavation continues as the structure is lifted until all of the extension units 108 and the base unit 106 are out of the excavation and the excavation fully filled to the desired level. For example, from the initial position shown in FIG. 22, FIG. 23 shows a point at which the upper three extension units 108 of the original shoring structure have been removed and the base unit 106 and remaining extension units 108 lifted by the hoisting system 125 and the excavation is filled in below. FIG. 24 shows a point in the extraction process where all of the extension units 108 of the original shoring structure shown in FIG. 22 have been removed, leaving only the base unit 106 in the remaining portion of the excavation 101.

In some cases, the excavation wall 102 may partially collapse against the outer surface of the shoring structure that remains in the excavation. The collapsed material produces a skin friction against the outer surface of the structure (the base unit wall outer surface 303 and extension unit wall outer surface 1303 of any remaining extension unit 108). This skin friction resists the lifting force that may be provided by the hoisting system 125 to the point at which the hoisting capacity of the hoisting system 125 is exceeded. In these cases, the extraction process includes placing jacking devices 2201 to provide an extraction jacking force to lift the shoring structure or portion thereof remaining in the excavation. Each jacking device 2201 is positioned to act between the excavation bottom 103 and a respective jack receiver (such as jack receiver 325 in FIGS. 4-6) of the base unit 106 and shown diagrammatically in FIGS. 22-24. The jacking devices 2201 are then operated to apply a respective extraction jacking force upwardly against the respective jack receiver to lift the shoring structure out of the excavation 101. This jacking process may be used to lift the shoring structure a desired distance upwardly within the range of extension of the jacking devices 2201 and then the jacking devices may be removed to fill in the excavation. The jacking devices may then be reinstalled to act against the new, higher bottom of the excavation in view of the additional fill material, and again operated to lift the shoring structure. This process of jacking the shoring structure may continue as needed until the entire structure including the base unit 106 and all extension units 108 are removed from the excavation and the excavation is filled to the desired level.

It should be noted that although FIGS. 22 through 24 each show both the hoist cables/chains 135 connected to the lifting feature of the base unit 106 and the extraction jacking devices 2301, it may not be necessary to retain the hoisting system 125 in place, and instead rely on the jacking system for lifting the shoring structure.

In situations where the bottom of the excavation is unstable and readily caves in as the shoring structure made up of base unit 106 and extension units 108 is extracted, the extraction shield 109 may be used to prevent caving in while still allowing the shoring structure to be extracted. Since the extraction shield 109 includes a wall with no extensions or protuberances on the outer surface or inner surface, the process may include filling in the excavation within the volume defined by the extraction shield while maintaining the shoring structure at a point at which the lower edge of the extraction shield 109 is at or below the filled in level of the excavation 101. While this backfilling inside the volume of the extraction shield does produce some skin friction along the extraction shield wall inner surface, the lack of protuberances and the relative short height of the extraction shield wall, that may be 1 to 3 feet for example, allows the shoring structure or remaining part thereof to be lifted, particularly with the extraction jacking process. This process of filling in the volume of the extraction shield allows the extraction shield wall to always remain in place at the bottom of the excavation to prevent the influx of material collapsing from the excavation wall 102.

In some locations the soil and rock near the surface may be very loose and unconsolidated. In those locations it may be desirable to use a larger (in the lateral direction) shoring structure unit to protect the excavation and installation during the process described in connection with FIGS. 18-21. FIG. 25 shows such a surface shoring unit 2506 installed prior to the installation of the structure made up of base unit 106 and extension units 108. Surface shoring unit 2506 may have a structure similar to that of base unit 106 with lifting features and jacking lugs. When such a surface shoring unit 2506 is used, it may be installed essentially in the same way the base unit 106 is installed to the position shown in FIG. 18. Referring to FIG. 25, an excavation 2501 is made having a side wall 2502 and ultimately an excavation bottom 2503. A dewatering shaft 2504 and pump 2505 may be required in areas having ground water near the surface 112. Once the surface shoring unit 2506 is in place as shown in FIG. 25, base unit 106 and extension units may be installed in the process described in FIGS. 18-21 but starting from the surface excavation bottom 2503. When the shoring structure is removed, the base unit 106 and extension units 108 are extracted as described in connection with FIGS. 22-24. Surface shoring unit 2506 may then be extracted from the surface excavation 2501 in FIG. 25. It will be appreciated that the installation jacking and extraction jacking techniques described above in connection with base unit 106 may also be applied in installing and extracting, respectively, surface shoring unit 2506.

The various components of a base unit 106, extension unit 108, and surface shoring unit in accordance with aspects of the invention may be formed from any suitable material or combination of materials. For example, the base unit wall 301, extension unit wall 1301, and the various plates used in these structures may all comprise high strength steel or some other suitable material. The connections of plate components such as the stiffening rings 314, 315, and 316 of the base unit 106 may be welded in place on the base unit wall inner surface 302. Other components of the base unit 106 such as the lifting lugs 138 and jacking lugs may also be joined by welding.

The jacking devices such as installation jacking devices 2102 and extraction jacking devices 2201 may comprise hydraulic, pneumatic, electrical, or mechanical jacking devices, or combinations thereof.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

In the above descriptions and the following claims, terms such as top, bottom, upper, lower, and the like with reference to a given feature are intended only to identify a given feature and distinguish that feature from other features and are made with reference to the orientation of the various devices and structures shown in the drawings.

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements that does not have the defined characteristic or feature unless explicitly stated otherwise.

The above-described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A device for shoring temporary surface excavations, the device including:

(a) a base unit defining a base unit wall, the base unit wall extending in a height direction from a base unit lower edge to a base unit upper edge and having a base unit wall inner surface defining a volume of the base unit and a base unit wall outer surface facing way from the volume of the base unit, wherein (i) the base unit wall outer surface at each point along the length of the base unit wall in the height direction extends along the distance from the base unit lower edge to the base unit upper edge approximately parallel to a base unit central axis extending in the height direction, and (ii) the base unit wall outer surface defines the maximum dimension of the base unit along any line that intersects the base unit central axis perpendicular to the base unit central axis, and (iii) the base unit wall defines a barrier to the volume of the base unit in directions transverse to the base unit central axis;

(b) at least two jacking lugs mounted on the base unit and spaced apart about the base unit central axis, each jacking lug including a direct connection to the base unit wall inner surface and extending from the base unit wall inner surface in the volume of the base unit and each jacking lug further including a jack receiver positioned to receive an upper jacking force application element of a respective jacking device aligned to apply a jacking force in a direction from the base unit lower edge to the base unit upper edge;

(c) at least two lifting features mounted on the base unit and spaced apart about the base unit central axis, each lifting feature residing within the volume of the base unit and providing a lifting point adapted to accept a lifting force applied from above the base unit upper edge in the height direction; and (d) a number of upper connecting elements spaced apart about the base unit central axis, each upper connecting element being proximate to the base unit upper edge.

2. The device of claim 1 wherein the base unit includes three or more of the jacking lugs spaced apart approximately equally about the base unit central axis.

3. The device of claim 1 wherein the base unit includes three or more of the lifting features spaced apart approximately equally about the base unit central axis.

4. The device of claim 1 wherein at least one of the lifting features is located on a respective lifting lug mounted on the base unit, the respective lifting lug comprising a structure separate from any of the jacking lugs and extending from the base unit wall inner surface in the volume of the base unit.

5. The device of claim 1 wherein the base unit further includes at least one horizontal stiffening ring mounted on the base unit inner wall surface, each horizontal stiffening ring including a continuous plate material oriented in a plane perpendicular to the base unit central axis and having an outer edge secured to the base unit inner wall surface and an inner edge extending into the volume of the base unit.

6. The device of claim 5 wherein:

(a) one horizontal stiffening ring comprises an upper stiffening ring mounted on the base unit wall inner surface in an area approximately bounded by the base unit upper edge; and (b) at least some of the number of upper connecting elements are mounted on the upper stiffening ring.

7. The device of claim 5 wherein:

(a) one horizontal stiffening ring comprises a lower stiffening ring mounted on the base unit wall inner surface in an area approximately bounded by the base unit lower edge; and (b) a number of lower connecting elements are mounted on the lower stiffening ring and spaced apart about the base unit central axis.

8. The device of claim 1 wherein at least a respective one of the jacking lugs comprises a jacking lug structure including:

(a) a first elongated connection to the base unit wall inner surface;

(b) a second elongated connection to the base unit wall inner surface, wherein the first elongated connection to the base unit wall inner surface and the second elongated connection to the base unit wall inner surface each extend in the height direction and are spaced apart from each other in a direction transverse to the height direction;

(c) a jacking lug receiver surface supported in the jacking lug structure in an area between the first elongated connection to the base unit wall inner surface and the second elongated connection to the base unit wall inner surface, the jack receiver of the respective jacking lug being positioned on the jacking lug receiver surface; and (d) the first elongated connection to the base unit wall inner surface and the second elongated connection to the base unit wall inner surface provide the direct connection to the base unit wall inner surface of the respective jacking lug and each include an upper connection portion extending above the jacking lug receiver surface and a lower connection portion extending below the jacking lug receiver surface.

9. The device of claim 1 wherein at least a respective one of the jacking lugs comprises a jacking lug structure including:

(a) a jacking lug plate extending transverse to the height direction;

(b) two upper plates located above the jacking lug plate in the height direction and being spaced apart from each other in a direction transverse to the height direction, each upper plate being connected at a respective lower end to the jacking lug plate and having an elongated upper plate connection to the base unit wall inner surface providing an upper portion of the direct connection between the respective jacking lug and the base unit wall inner surface;

(c) two lower plates located below the jacking lug plate in the height direction and being spaced apart from each other in the direction transverse to the height direction, each lower plate being connected at a respective upper end to the jacking lug plate and having an elongated lower plate connection to the base unit wall inner surface providing a lower portion of the direct connection between the respective jacking lug and the base unit wall inner surface; and (d) wherein the jack receiver is located on the jacking lug plate between the two lower plates.

10. An assembly for shoring temporary surface excavations, the assembly including:

(a) a base unit including:

a base unit wall extending in a height direction from a base unit lower edge to a base unit upper edge and defining a base unit central axis extending in the height direction, the base unit wall also having a base unit wall inner surface defining a volume of the base unit and a base unit wall outer surface facing way from the volume of the base unit, and (ii) at least two jacking lugs mounted on the base unit and spaced apart about the base unit central axis, each jacking lug including a direct connection to the base unit wall inner surface and extending from the base unit wall inner surface in the volume of the base unit and each jacking lug further including a jack receiver positioned to receive an upper jacking force application element of a respective jacking device aligned to apply a jacking force in a direction from the base unit lower edge to the base unit upper edge, and (iii) at least two lifting features mounted on the base unit and spaced apart about the base unit central axis, each lifting feature residing within the volume of the base unit and providing a lifting point adapted to accept a lifting force applied from above the base unit upper edge in the height direction, and (iv) a number of base unit upper connecting elements spaced apart about the base unit central axis;

(b) a first extension unit including:

(i) a first extension unit wall extending in the height direction from a first extension unit lower edge to a first extension unit upper edge and defining a first extension unit central axis extending in the height direction, the first extension unit wall also having a first extension unit wall inner surface defining a volume of the first extension unit and a first extension unit wall outer surface facing way from the volume of the first extension unit, and (ii) a number of first extension unit lower connecting elements spaced apart at about the first extension unit central axis, each extension unit lower connecting element being aligned with and connected to a respective base unit upper connecting element of the base unit so that the base unit central axis approximately aligns with the first extension unit central axis;

(c) wherein (i) the base unit wall outer surface at each point along the length of base unit wall in the height direction extends along the distance from the base unit lower edge to the base unit upper edge approximately parallel to the base unit central axis, and (ii) the base unit wall outer surface defines the maximum dimension of the base unit along any line that intersects the base unit central axis perpendicular to the base unit central axis, and (iii) the base unit wall defines a barrier to the volume of the base unit in directions transverse to the base unit central axis; and (d) wherein (i) the first extension unit wall outer surface at each point along the length of the first extension unit wall extends along the distance from the first extension unit lower edge to the first extension unit upper edge approximately parallel to the first extension unit central axis, and (ii) the first extension unit wall outer surface defines the maximum dimension of the first extension unit along any line that intersects the first extension unit central axis perpendicular to the first extension unit central axis, and (iii) the first extension unit wall defines a barrier to the volume of the first extension unit in directions transverse to the first extension unit central axis.

11. The assembly of claim 10 wherein the base unit wall outer surface at each point along the length of the base unit wall approximately aligns with the first extension unit wall outer surface at a respective corresponding point along the length of the first extension unit wall so that the base unit wall outer surface at a respective point along the length of the base unit wall and the first extension unit wall at the corresponding point along the first extension unit wall define a line extending substantially continuously from the first extension unit upper edge to the base unit lower edge and substantially parallel to both the base unit central axis and the first extension unit central axis.

12. The assembly of claim 11 wherein the base unit wall outer surface and the first extension unit wall outer surface together define a substantially continuous cylindrical shape.

13. The assembly of claim 8 further including a structure comprising at least one additional extension unit wherein:

(a) each additional extension unit includes a respective additional extension unit wall extending in the height direction from a respective additional extension unit lower edge to a respective additional extension unit upper edge and defining a respective additional extension unit central axis extending in the height direction, the respective additional extension unit wall also having a respective additional extension unit wall inner surface defining a volume of the respective additional extension unit and a respective additional extension unit wall outer surface facing way from the volume of the respective additional unit;

(b) a lowermost one of the at least one additional extension units includes number of additional extension unit lower connecting elements spaced apart at about the respective additional extension unit central axis, each respective additional extension unit lower connecting element being aligned with and connected to a respective first extension unit upper connecting element of the first extension unit so that each additional extension unit central axis approximately aligns with both the base unit central axis and the first extension unit central axis; and (c) for each respective additional extension unit (i) the respective additional extension unit wall outer surface at each point along the length of the respective additional extension unit wall extends along the distance from the respective additional extension unit lower edge to the respective additional extension unit upper edge approximately parallel to the respective additional extension unit central axis, and (ii) the respective additional extension unit wall outer surface defines the maximum dimension of the respective additional extension unit along any line that intersects the respective additional extension unit central axis perpendicular to the respective additional extension unit central axis, and (iii) the respective additional extension unit wall defines a barrier to the volume of the respective additional extension unit in directions transverse to the respective additional extension unit central axis.

14. The assembly of claim 13 wherein the base unit wall outer surface at each point along the length of the base unit wall approximately aligns with the first extension unit wall outer surface at a respective corresponding point along the length of the first extension unit wall and with each respective additional extension unit wall outer surface at a corresponding point along the length of the respective additional extension unit so that the base unit wall outer surface at a respective point along the length of the base unit wall and the first extension unit wall at the corresponding point along the first extension unit wall and the respective additional extension unit wall at the respective corresponding point along the respective additional extension unit wall define a line extending substantially continuously along the entire assembly from an uppermost additional extension unit upper edge to the base unit lower edge and substantially parallel to the base unit central axis, the first extension unit central axis, and each respective additional extension unit central axis.

15. A method including:

(a) excavating an area within a first excavation perimeter to produce a first excavation volume having a first excavation depth from a surface level;

(b) lowering a base unit into the first excavation volume, base unit defining a base unit wall that extends in a height direction from a base unit lower edge to a base unit upper edge and defining a base unit central axis extending in the height direction, the base until wall also having a base unit wall inner surface defining a volume of the base unit and a base unit wall outer surface facing way from the volume of the base unit, wherein lowering the base unit into the first excavation volume places the base unit lower edge proximate to a bottom surface of the first excavation volume;

(c) with the base unit remaining in the first excavation volume, excavating within the first excavation perimeter further to produce a second excavation volume having a second excavation depth from the surface level greater than the first excavation depth;

(d) connecting at least one extension unit to the base unit while at least a portion of the base unit remains in the first excavation volume, each extension unit defining a respective extension unit wall extending in the height direction from a respective extension unit lower edge to a respective extension unit upper edge and defining a respective extension unit central axis extending in the height direction, each respective extension unit wall also having a respective extension unit wall inner surface defining a volume of the respective extension unit and a respective extension unit wall outer surface facing way from the volume of the respective extension unit, connecting the at least one extension unit to the base unit forming a shoring structure having a vertical exterior surface defined by the base unit wall outer surface and the respective extension unit wall outer surface of each of the at least one extension units with each respective extension unit central axis aligned with the base unit central axis to form an assembly central axis;

(e) with the base unit connected to the at least one extension unit and with the base unit remaining in the second excavation volume, excavating within the first excavation perimeter to produce a third excavation volume having a third excavation depth from the surface level greater that the second excavation depth; and (f) with the base unit residing at least partially in the second excavation volume or third excavation volume, applying an installation jacking force to the shoring structure to force the shoring structure further into the third excavation volume.

16. The method of claim 15 wherein the installation jacking force is applied to the shoring structure through at least two spaced apart locations of an uppermost one of the at least one extension unit at the respective extension unit wall along an axis defined by that wall parallel to the respective extension unit central axis.

17. The method of claim 15 wherein the installation jacking force is applied to the shoring structure from a support structure located above the shoring structure and further including connecting the support structure via a force resistance arrangement to at least one anchoring device fixed at a bottom surface of the third excavation volume.

18. A method including:

(a) placing at least two jacking devices within a volume of a shoring structure residing within an excavation with a lower edge of the shoring structure below a surface level, each jacking device being positioned in a respective operating position to apply a respective extraction jacking force to a respective jack receiver arrangement mounted on the shoring structure within the volume of the shoring structure, the respective extraction jacking force comprising a compression force applied to the respective jack receiver arrangement and sufficient to lift the respective jack receiver arrangement;

(b) applying each respective extraction jacking force to the respective jack receiver arrangement to lift the shoring structure upwardly toward the surface level;

(c) after applying each respective extraction jacking force to the respective jack receiver arrangement to lift the shoring structure upwardly toward the surface level and with the shoring structure supported against substantial movement in a downward direction away from the surface level with the lower edge of the shoring structure remaining in the excavation below surface level, filling in the excavation with fill material at least in an area below the lower edge of the shoring structure; and (d) removing the shoring structure from the excavation after filling in the excavation with fill material at least in the area below the lower edge of the shoring structure.

19. The method of claim 18 further including before removing the shoring structure from the excavation and after the shoring structure has been lifted upwardly toward the surface level:

(a) placing each of the at least two jacking devices within the volume of the shoring structure in their respective operating position;

(b) applying each respective extraction jacking force to the respective jack receiver arrangement to lift the shoring structure upwardly toward the surface level; and (c) after applying each respective extraction jacking force to the respective jack receiver arrangement to lift the shoring structure upwardly toward the surface level and with the shoring structure supported against substantial movement in a downward direction away from the surface level, filling in the excavation further with additional fill material in an area at least below the lower edge of the shoring structure.

20. The method of claim 18 wherein:

(a) the shoring structure includes a base unit and one or more extension units located above the base unit in the excavation; and (b) removing the shoring structure from the excavation includes separating one of the one or more extension units from the shoring structure while the base unit remains at least partially in the excavation.

21. The method of claim 20 further including after the shoring structure has been lifted upwardly toward the surface level and after separating the one of the one or more extension units from the shoring structure, but before removing a remainder of the shoring structure from the excavation:

(a) placing each of the at least two jacking devices within the volume of the shoring in their respective operating position;

(b) applying each respective extraction jacking force to the respective jack receiver arrangement to lift the remainder of the shoring structure upwardly toward the surface level; and (c) after applying each respective extraction jacking force to the respective jack receiver arrangement to lift the remainder of the shoring structure upwardly toward the surface level and with the remainder of the shoring structure supported against substantial movement in a downward direction away from the surface level, filling in the excavation further with additional fill material in an area below the lower edge of the shoring structure.

22. The method of claim 18 wherein placing each of the at least two jacking devices within the volume of the shoring structure in their respective operating position includes placing three or more jacking devices each in a respective operating position relative to a respective jack receiver.

* * * * *